US007740151B2

(12) United States Patent
Stone

(10) Patent No.: US 7,740,151 B2
(45) Date of Patent: Jun. 22, 2010

(54) PUMPING DISPENSER FOR VISCOUS LIQUIDS

(76) Inventor: William Bundy Stone, 1575 E. 66th St., Tulsa, OK (US) 74136-0724

( * ) Notice: Subject to any disclaimer, the term of this patent is extended or adjusted under 35 U.S.C. 154(b) by 373 days.

(21) Appl. No.: 11/820,404

(22) Filed: Jun. 19, 2007

(65) Prior Publication Data

US 2008/0314932 A1 Dec. 25, 2008

(51) Int. Cl.
*B67D 7/58* (2010.01)

(52) U.S. Cl. ..... 222/95; 222/105; 222/189.1; 222/209; 222/211; 222/401; 222/464.1; 137/212; 417/118; 417/473

(58) Field of Classification Search ..... 222/95, 222/105, 189.1, 209, 211, 400.8, 401, 464.1–464.2, 222/321.3, 375; 137/212; 417/118, 472–473, 417/475

See application file for complete search history.

(56) References Cited

U.S. PATENT DOCUMENTS 2,823,953 A * 2/1958 McGeorge ..... 222/320
4,020,978 A * 5/1977 Szczepanski ..... 222/209
4,062,475 A * 12/1977 Harris et al. ..... 222/95
4,159,790 A * 7/1979 Bailey ..... 222/211
5,740,949 A * 4/1998 Park ..... 222/209
6,460,740 B2 * 10/2002 Simard ..... 222/382

* cited by examiner

*Primary Examiner*—Kevin P Shaver
*Assistant Examiner*—Andrew P Bainbridge
(74) *Attorney, Agent, or Firm*—Molly D. McKay

(57) ABSTRACT

A hand operated air pump apparatus comprising an internal bellows in communication with an outer bellows wherein variable force on air pump forces compressed air through a discharge valve into a annulus between a bottle and a flexible bladder wherein said pump is attached upon a container or bottle like vessel wherein pumping action forces from bottle highly viscous substances, that may contain solid or abrasive particles, through a discharge spout without internal substance being contaminated by air or other environmental factors thus allowing for an improved method of removing all contents within a container with greater ease.

5 Claims, 24 Drawing Sheets

PUMPING DISPENSER FOR VISCOUS LIQUIDS

BACKGROUND OF THE INVENTION

1.) Field of the Invention

This invention relates generally to jars, bottles, and tubes of highly viscous and or thixotropic liquids, such as hand lotions, toothpaste, greases, and expensive cosmetic lotions to be dispensed and more specifically details an improved novel method of pumping these liquids that may contain solids or abrasive particles from their containers.

One problem with existing dispensers is that most hand lotion bottles come with vertical reciprocating hand pumps that will pump the viscous liquid while the bottle is full. As the level of the lotion, or viscous liquid, drops in the bottle the hydrostatic head pressure on the suction side of the pump decreases and the pump quits pumping efficiently, leaving expensive liquid in the bottle which is wasteful to the consumer.

A second problem is that vertical reciprocation hand pumps only allow the viscous liquid to be pumped while the container bottle is in a vertical position.

A third problem is that vertical reciprocation hand pumps allow atmospheric air to be exposed to the viscous liquid in the lotion bottle drying it out.

A fourth problem is that vertical reciprocation hand pumps allow atmospheric air to be exposed to the viscous liquid in a bottle contaminating the sterilized viscous liquid.

A fifth problem is that many expensive cosmetic lotions, or viscous liquids, require chemical extenders, thinning agents, and or plasticizers, in various expensive combinations, to reduce the viscosity of the liquid so that it may be pumped. This adds to the cost of the viscous liquid and requires a larger bottle that must be purchased, filled, handled, labeled, stored, & transported which is wasteful.

A sixth problem is that viscous liquids produced in squeeze bottles or tubes are effected by atmospheric pressure and temperature changes which may cause the viscous liquid to be inadvertently expelled from the tube or bottle which is wasteful.

A seventh problem is that highly viscous and or thixotropic liquids offered in open topped jars with snap on or screwable lids are open to the atmosphere while being dispensed contaminating the sterilized viscous liquid.

A eight problem is that weak, arthritic, elderly, or physically challenged people sometimes have a very difficult time generating sufficient hand forces to squeezing tubes of highly viscous materials or generating a sufficient twisting motions to remove and replace screwable lids containing needed material.

Therefore, the primary objective of this novel invention is to eliminate all of the above problems by using compressed air generated by a small air pump on the container bottles to squeeze a bladder forcing the highly viscous and or thixotropic liquids non contaminated liquid from the bottle in any attitude, vertical horizontal, or rotated at any angle.

A second object of this invention is to allow an individual to operate the lotion pump with one finger or hand.

A third object of this invention is to release the hand-pumped up compressed air, by stopping the pumping action and removing the hand or finger from the lotion pump, which will stop the dispensing of the vicious liquid.

2.) Description of the Related Art

U.S. Pat. No. 7,137,531 B2 Relates to a flexible bag commonly called a "bag-in-a-Box", in the art, that is used to displace fluids such as wine and liquid soaps. The bag is not compressed by external pressure to discharge the liquids and does not relate to this invention.

U.S. Pat. No. 6,460,739 B2 relates to a dispenser for viscous or viscous products, liquids, which has a closure, which closure automatically closes the dispenser exit and relates to closures which this invention does not specifically relate to.

U.S. Pat. No. 6,073,804 relates to a device for packaging and dispensing a fluid that includes a shrinkable bag suitable for shrinking as the quantity of viscous fluid contained inside it diminishes, and an extraction means opening out to the inside of the bag. The bag is shrunk or squeezed by a propellant gas that as we know is hazardous to fill, transport and store and sometimes harmful to the environment. U.S. Pat. Nos. 4,793,522; 4,872,596; and 4,890,733 all relate to pumping viscous products that use a floating piston that is driven into the displaced product by atmospheric pressure. The product being displaced by a positive displacement pump relies on the seal of the floating piston to keep the suction side of the pump primed. We all know that sliding seals of any kind eventually leak which renders these types of dispensers for viscous liquids ineffective.

SUMMARY OF THE INVENTION

In accordance with the invention a small hand operated air pump is mounted on a dispenser bottle. By application of a variable pumping force on the top of the air pump, the air pump pumps compressed air into an annulus, between the dispenser bottle, and flexible bladder that contains the viscous liquid, that may contain solid or abrasive particles, squeezing the flexible bladder.

Squeezing the flexible bladder, with compressed air in the annulus, forces the viscous liquid, up a dispenser tube, through the discharge spout, through a flex disk, and into a receiving vessel or a hand.

From the foregoing, it will be apparent that the present invention provides for a novel and unique means for dispensing viscous substance with the added benefit of keeping the substance contaminate free.

Whereas the present invention has been described in particular relationship to the drawings attached hereto, it should be understood that other and further modifications apart from those shown or suggested herein may be made within the scope of the invention and its claims.

DESCRIPTION OF THE DRAWING ITEMS

10—Top Cap
11—Air Bleed Holes
12—Guide Fingers
13—Bottom of Top Cap
15—Inner Ring
16—Outside Surface
20—Pump Top
21—Bottom of Pump Top
22—Outside Ring
23—Top of Pump Top
24—Interior Surface
30—Exterior Bellows
40—Interior Bellows
50—Pump Bottom
51—Air Suction Holes
52—Discharge Hole (Air Pump)
53—Outside Ring
54—Inside Ring
55—Sealing Surface (Pump bottom)
56—Sealing Surface (Pump bottom)
57.—Interior Surface
58—Outside Surface of Inner Ring
59—Locating Slot
60—Annulus Discharge Hole
62—Inside Surface
63—Lower Ring
70—Discharge Valve
71—Sealing Surface (Discharge Valve)
72—Locating Dog
73—Compression Slot
80—Bottle Cap
81—Upper Ring
82—Air Passage Slots
83—Female Threads
84—Surface
85—Hole
86—Stop
87—Hole
88—Stop
89—Outer Surface of Upper Ring
90—Discharge Spout
91—Outer Surface
92—Inner Ledge
93—Web
100—Flex Disk
101—Outer Surface
102—Top Ledge
103—Flex Disk Slot
110—Suction Valve
111—Outside Sealing Surface
112—Locating Dog
113—Compression. Slot
120—Tube
121—Outer Surface
122—Top of Tube
123—Sealing Surface
124—Male Ring
125—Outer Surface of Rib
126—Flutes
127—Annulus of Flutes
125—Outer Surface
130—Container Bottle
140—Flexible Bladder
141—Inner Sealing Surface
142—Female Recesses
143—Outer Surface
150—Clip
151—Inner Surface
152—Gap
160—Viscous Liquids
162—Air Pump
161—Annulus
163—Variable Pumping Force
165—Bellows Annulus
166—Interior Space
167—Annular Pressure Force
168—Residual Bellows Force
171—Male Threads
172—Bottle Top
199—Retainer
200—Keep
201—Holes

DETAILED DESCRIPTION OF THE INVENTION

Figure 1:
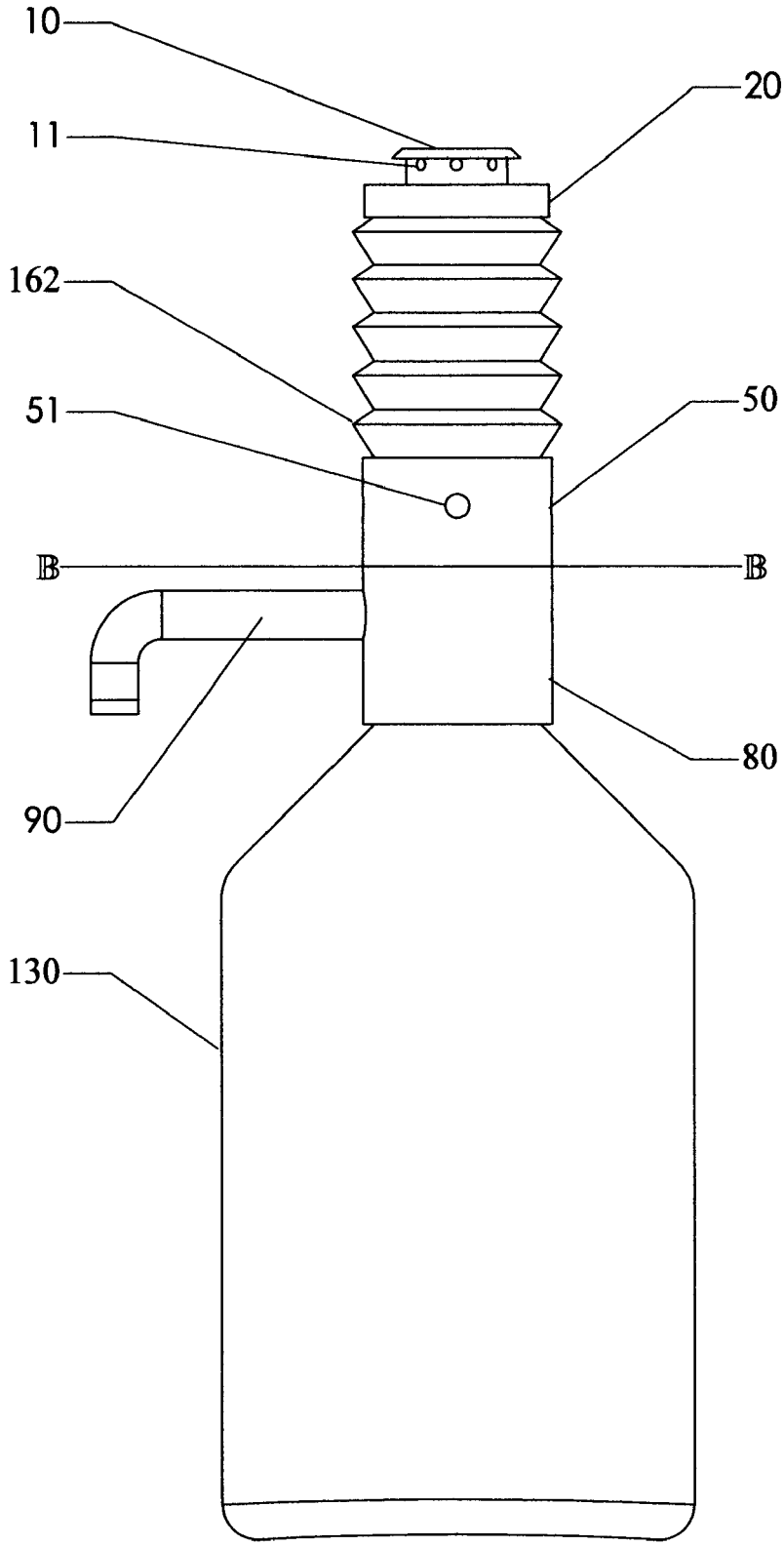
FIG. 1 is a front view of the air pump 162 which is defined as above line B-B, and the container bottle 130 which is defined as below line B-B showing the invention at rest.

Referring now to FIG. 1. The portion of the invention above line B-B is referred to as the air pump 162. The portion of the invention below line B-B is referred to as the container bottle 130. The invention is shown in the "at rest" position which is explained below in FIG. 4.

Figure 2:
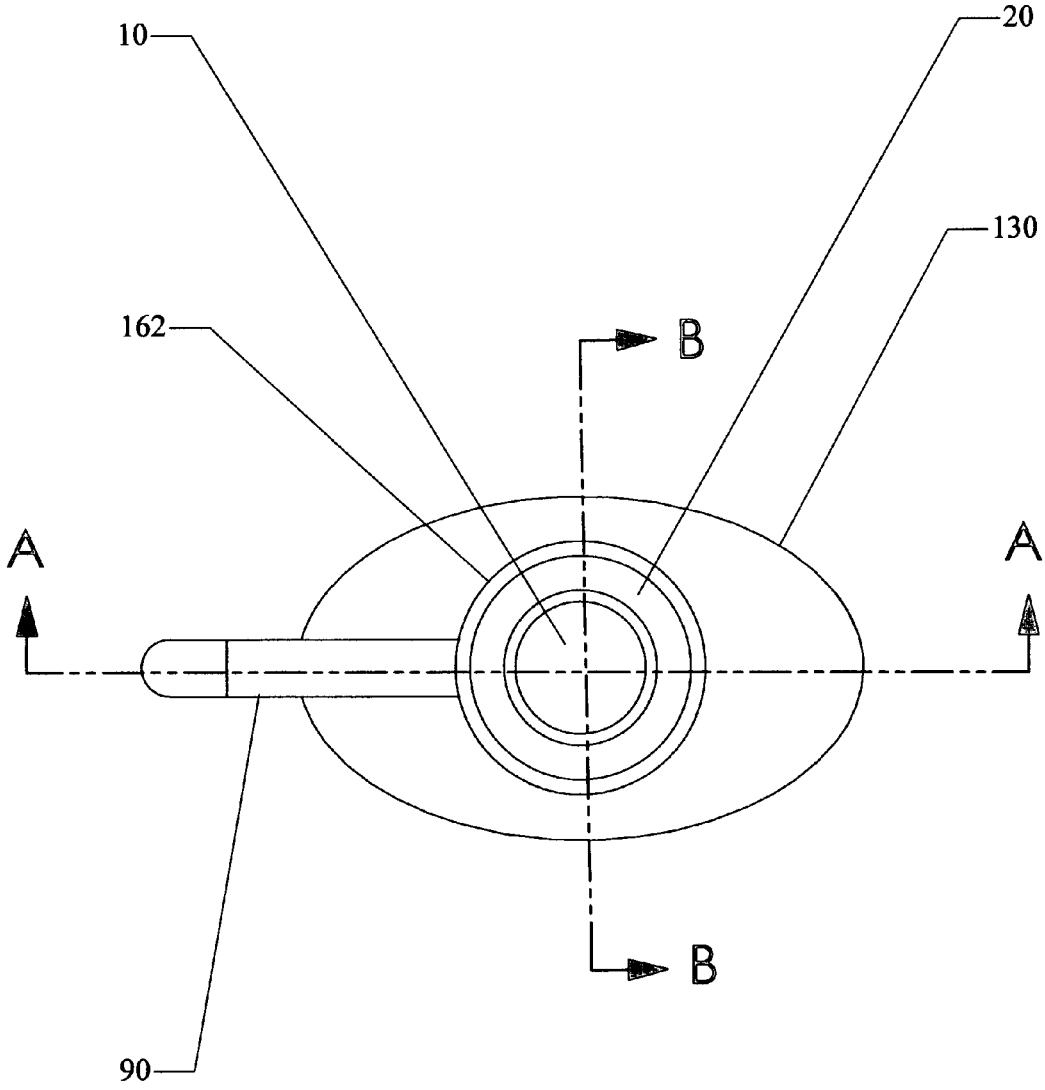
FIG. 2 is a top view of the air pump 162 and container 130 bottle at rest. Section line A-A arrows indicates the direction of view of the invention when referred to in section A-A. Section line B-B arrows indicates the direction of view of the invention when referred to in section B-B.

Referring now to FIG. 2. FIG. 2 is a top view of FIG. 1. Line A-A is a section line that shows arrowheads indicating the direction of views described in detail in the figures below. Line B-B is a section line that shows arrowheads indicating the direction of views described in detail in the figures below.

Figure 3:
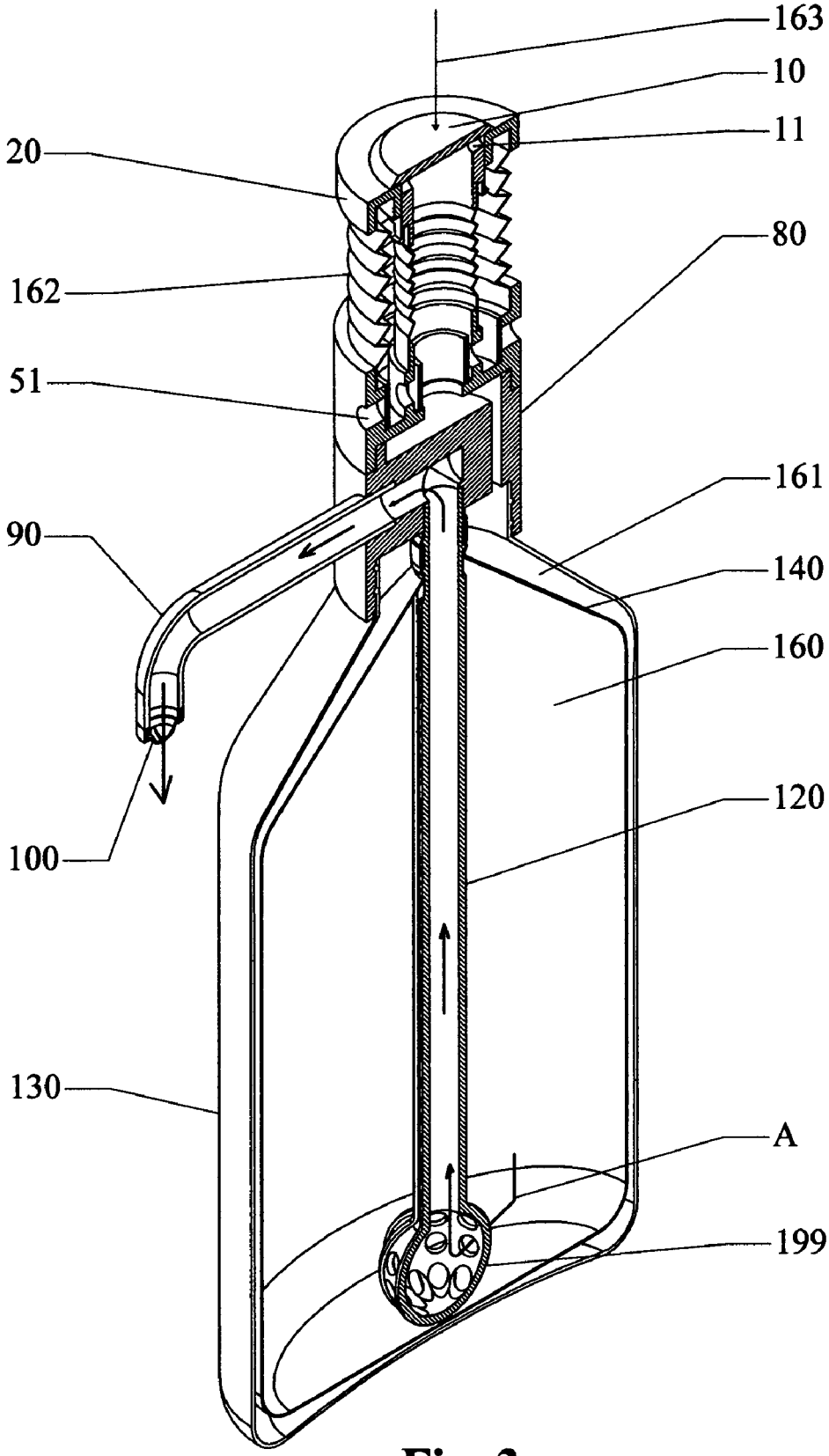
FIG. 3 is an isometric section A-A front view of the air pump 162 and container 130 bottle while pumping, in the direction of arrows A-A.

Referring now to FIG. 3 is an overview of the invention. The air pump 162 is shown in on its downward "pumping stroke" position in FIG. 3. By application of a variable pumping force 163, the air pump 162 (described in detail in FIGS. 4, 5, & 6) pumps compressed air into the annulus 161, between the container bottle 130, and flexible bladder 140, that contains the viscous liquid 160, that may contain solid or abrasive particles (not shown), squeezing the flexible bladder 140.

Still referring to FIG. 3. Squeezing the flexible bladder 140, with compressed air in the annulus 161, forces the viscous liquid 160, up the tube 120, in the direction of arrows A, through the discharge spout 90, through the flex disk 100, and into a receiving vessel or a hand (not shown).

Figure 4:
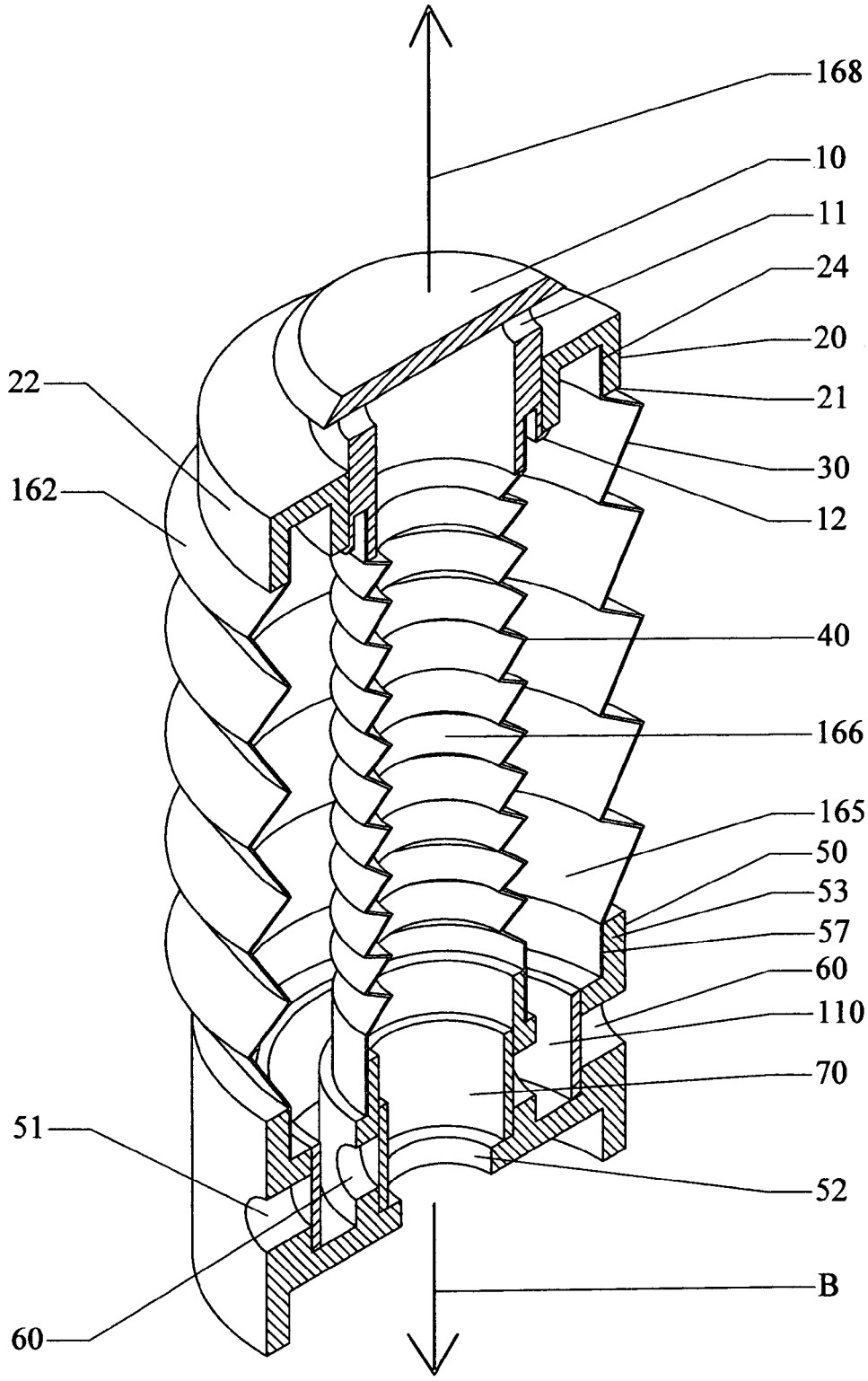
FIG. 4 is an isometric section A-A front view of the air pump 162 at rest in the direction of arrows A-A.
Figure 5:
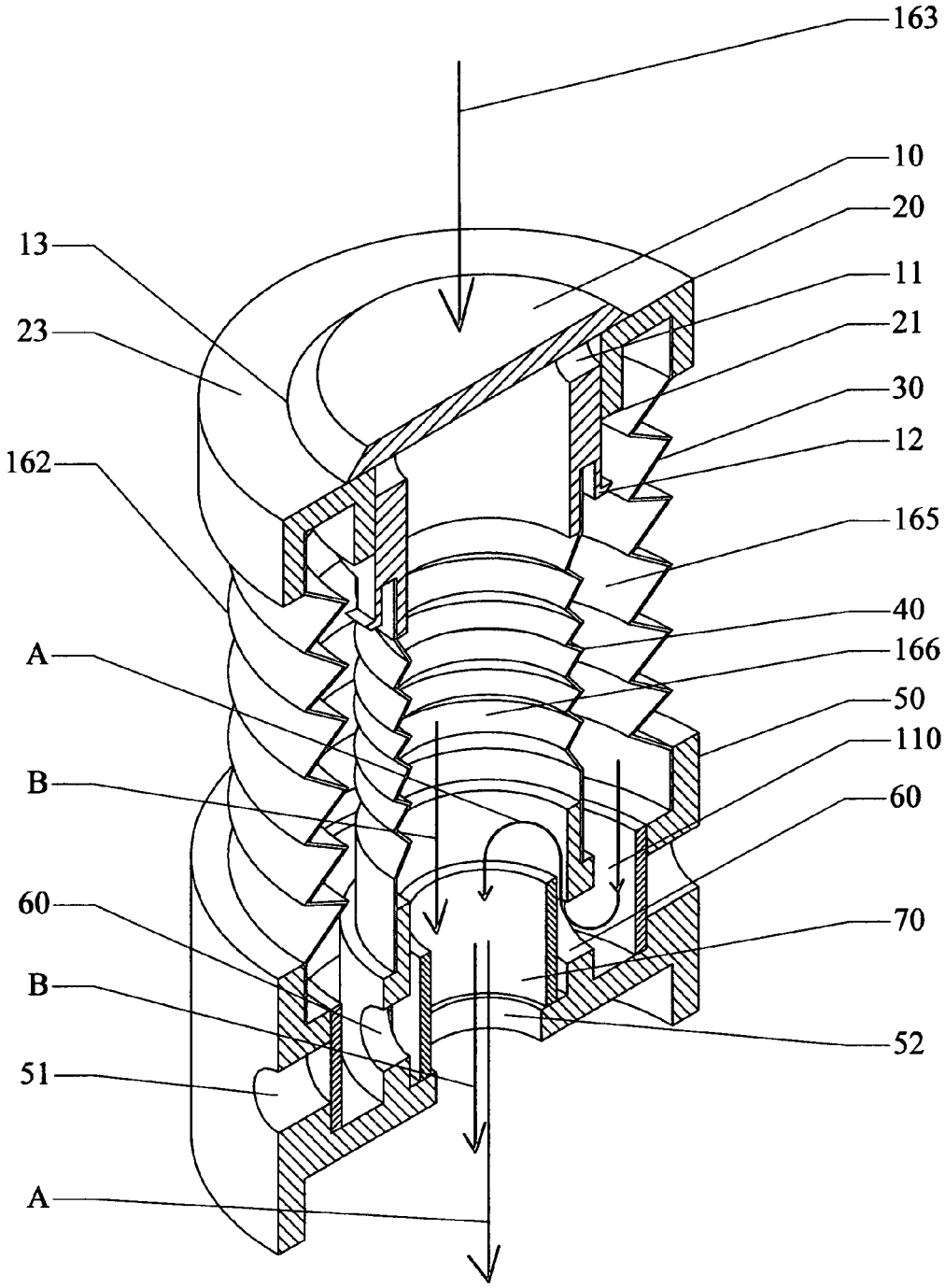
FIG. 5 is an isometric section A-A front view of the air pump 162 on its downward pumping stroke in the direction of arrows A-A.
Figure 6:
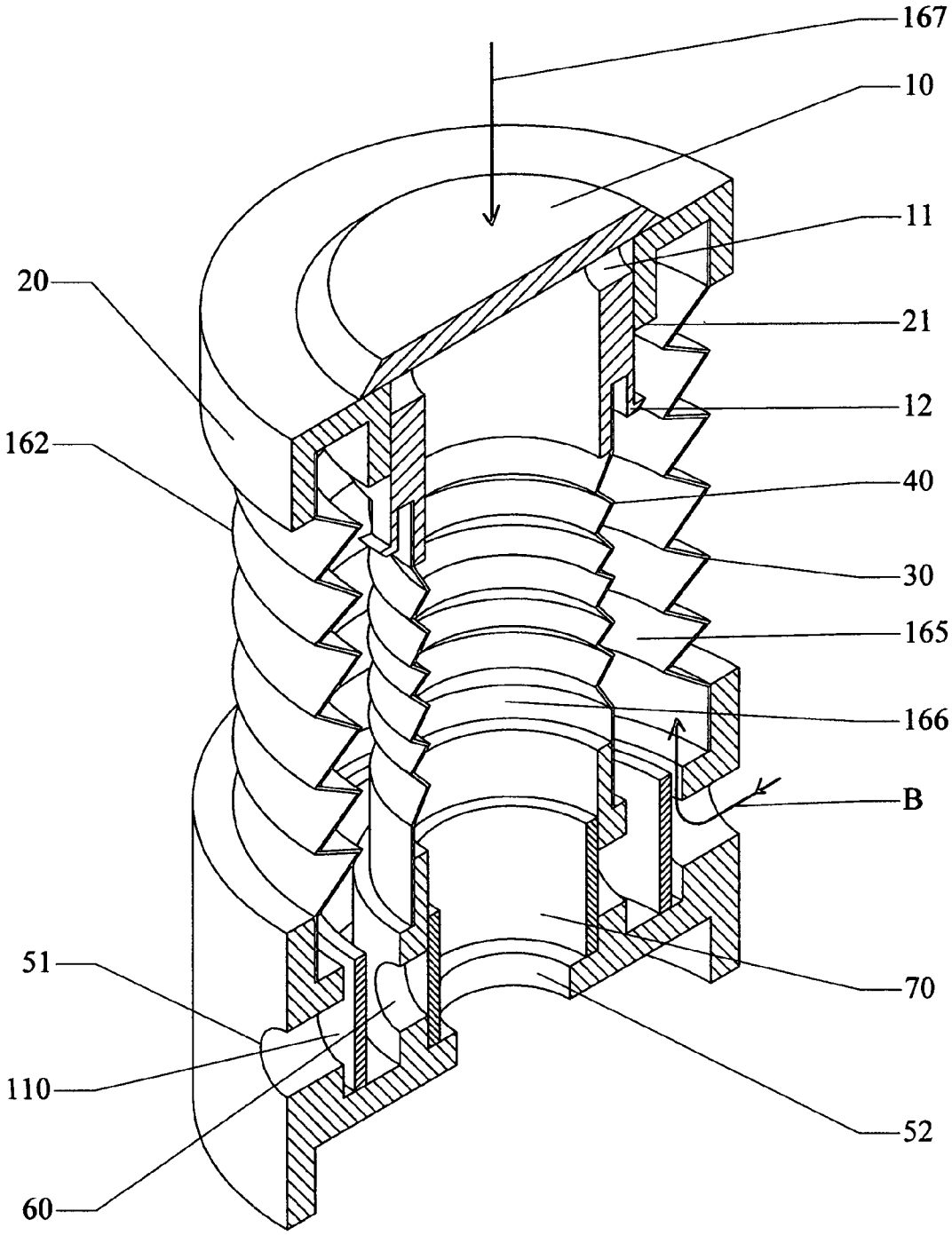
FIG. 6 is an isometric section A-A front view of the air pump 162 on its upward suction stroke in the direction of arrows A-A.

Referring now to detailed description of the air pump 162 using FIGS. 4, 5, & 6.

Figure 7:
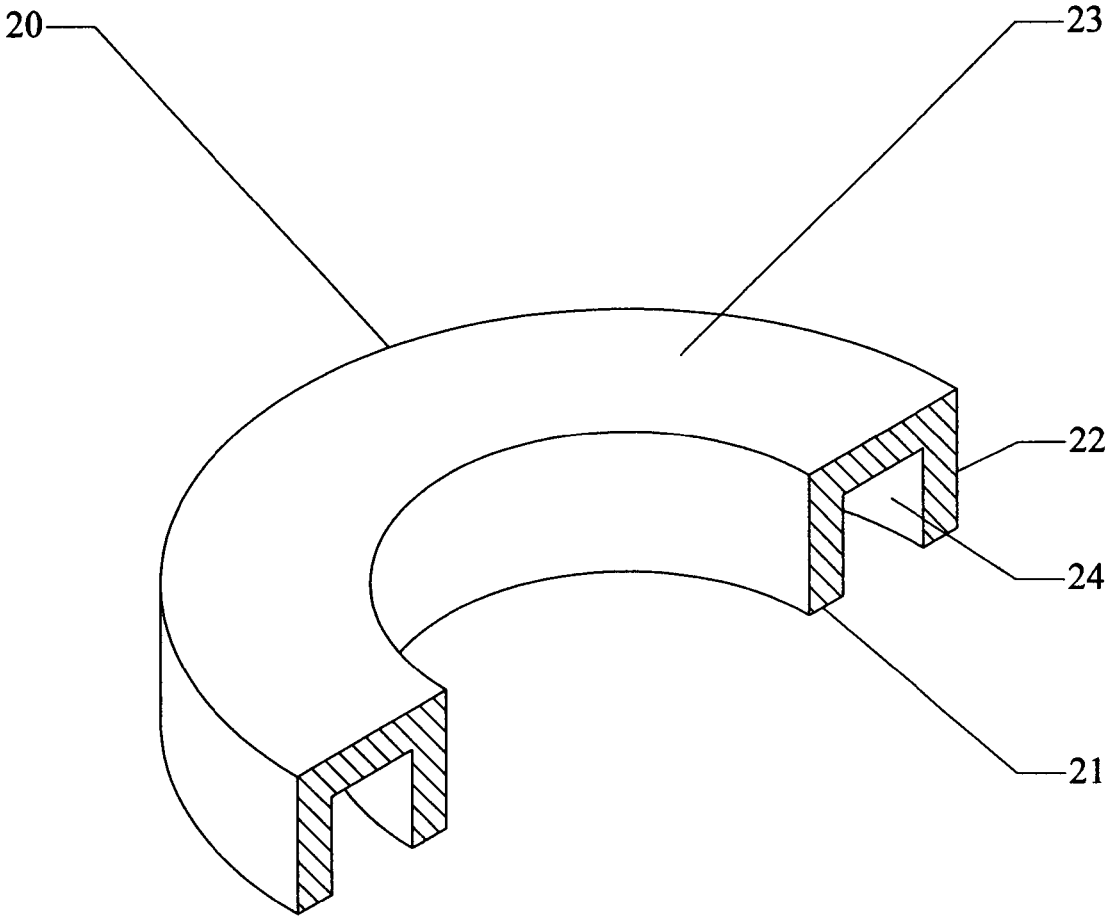
FIG. 7 is an isometric section A-A front view of the pump top 20 seen in the direction of arrows A-A.

Referring now to FIG. 4. FIG. 4 shows the air pump 162 in its up "at rest" position. The top cap 10, is in it's "at rest" up position as there is no downward variable pumping force 163 (FIG. 3), in the up "at rest" position. The interior bellows 40, has been so designed, spaced & constructed that in the air pumps up "at rest" position, a residual bellows force 168 is generated by the interior bellows 40 trying to expand further upward but can't as it is restrained by the top cap 10 and the fully expanded exterior bellows 30. The residual bellows force 168 is held, restrained, by the guide fingers 12 (FIG. 9) of the top cap 10, acting on the bottom 21 of the pump top 20 (FIG. 7).

Still referring to FIG. 4. The exterior bellows 30 has been glued or welded to the interior surface 24 of the outside ring 22 of the pump top 20 (FIG. 7) which is air tight.

Still referring to FIG. 4. The exterior bellows 30 has been glued or welded to the interior surface 57 of the outside ring 53 of the pump bottom 50 (FIG. 8) which is air tight.

Still referring to FIG. 4. The interior bellows 40 has been glued or welded to the outside surface 16 of the inner ring 15 of the top cap 10 (FIG. 9) which is air tight.

Still referring to FIG. 4. The interior bellows 40 has been glued or welded to the outside surface 58 of the inside ring 54 of the pump bottom 50 (FIG. 8) which is air tight.

Figure 8:
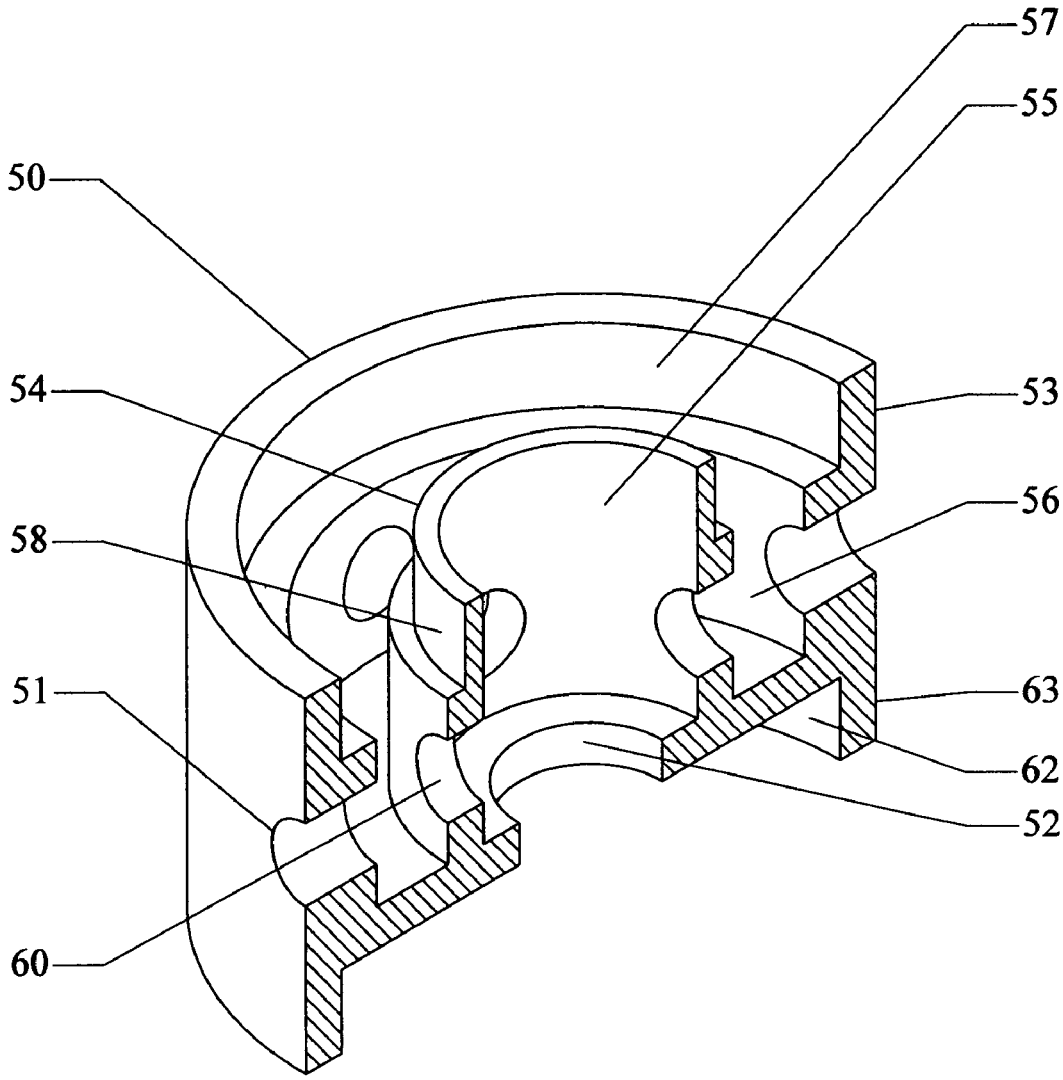
FIG. 8 is an isometric section A-A front view of the pump bottom 50 seen in the direction of arrows A-A.

Still referring to FIG. 4. In the "at rest" position the discharge valve 70 has its sealing surface 71 (FIG. 10) sealing against the sealing surface 55 of the pump bottom 50 closing off the annulus discharge holes 60 (FIG. 8).

Still referring to FIG. 4. The discharge valve 70 is so constructed that it's outside sealing surface 71 (FIG. 10) is slightly larger, on the diameter, than the inside sealing surface 55 of the pump bottom 50 (FIG. 8) and is therefore slightly preloaded in the closed sealing position as shown in FIG. 4, the "at rest" position.

Still referring to FIG. 4. In the "at rest" position the suction valves 110 outside sealing surface 111 (FIG. 11) is sealing against the sealing surface 56 of the pump bottom 50 (FIG. 8) closing off the suction air holes 51 (FIG. 8).

Still referring to FIG. 4. The suction valve 110 is so constructed that it's outside sealing surface 111 (FIG. 11) is slightly larger than the inner sealing surface 56 of the pump bottom 50 (FIG. 8) and is therefore slightly preloaded in the closed sealing position as shown in FIG. 4 the "at rest position."

Still referring to FIG. 4. As may be seen in FIG. 4 the air pump 162 (FIG. 1) discharge hole 52 of the pump bottom 50 (FIG. 8) is open to the atmosphere through the interior space 166 of the interior bellows 40, through the inside of the top cap 10 through the air bleed holes 11 of the top cap 10 (FIG. 9) so that ambient temperature fluctuations will not expand or contract any trapped air causing it to expand or contract against the outside of the flexible bladder 140 (FIG. 3), possibly causing the viscous liquid 160 to be discharged from the container bottle 130 (FIG. 3).

Still referring to FIG. 4. As may be seen in FIG. 4 the air suction holes 51 of the pump bottom 50 (FIG. 8) seals off the bellows annulus 165 when the air suction valve 110 (FIG. 11) is in its closed position as shown.

Figure 9:
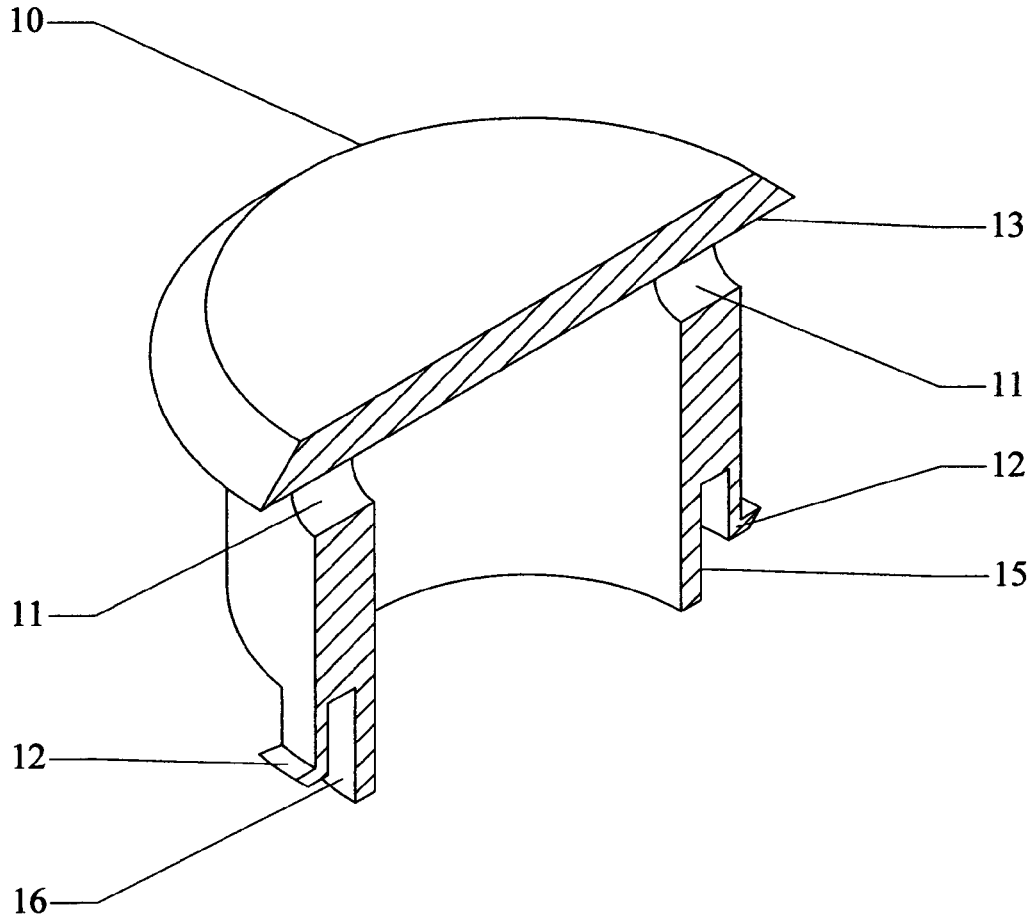
FIG. 9 is an isometric section A-A front view of the top cap 10 seen in the direction of arrows A-A.

Still referring to FIG. 4. Ambient temperature fluctuations acting on the trapped air in the bellows annulus 165 will, if the temperature increases, cause the trapped air to expand which will slightly open the discharge valve 70 (FIG. 10) relieving any trapped air pressure through the air bleed holes 11 in the top cap 10 (FIG. 9). If the ambient air temperature decreases, the trapped air in the bellows annulus 165 will decrease in volume and slightly open the suction valve 110 equalizing the air pressure. Therefore, ambient temperature swings will not cause the trapped air in the bellows annulus 165, or the air trapped in the interior space 166 to act on the flexible bladder 140 in any manner.

Referring now to FIG. 5. FIG. 5 shows the air pump 162 on its "pumping stroke" which requires a sufficient air pressure to be generated to pump the viscous liquid 160 (FIG. 3). The required air pressure requires that a sufficient variable pumping force 163 be generated as shown.

Still referring to FIG. 5. At the beginning of the "pumping stroke" the bottom 13 of the top cap 10 (FIG. 9) is pushed against the top 23 of the pump top 20 (FIG. 7) overcoming the residual bellows force 168 (FIG. 4) which seals off the air bleed holes 11 (FIG. 9) and traps the air pressure generated by the variable pumping force 163.

Still referring to FIG. 5. The required downward variable pumping force 163 is generated (by a hand or finger—not shown) to produce the required air pressure to pump the viscous liquid 160 (FIG. 3).

Figure 19:
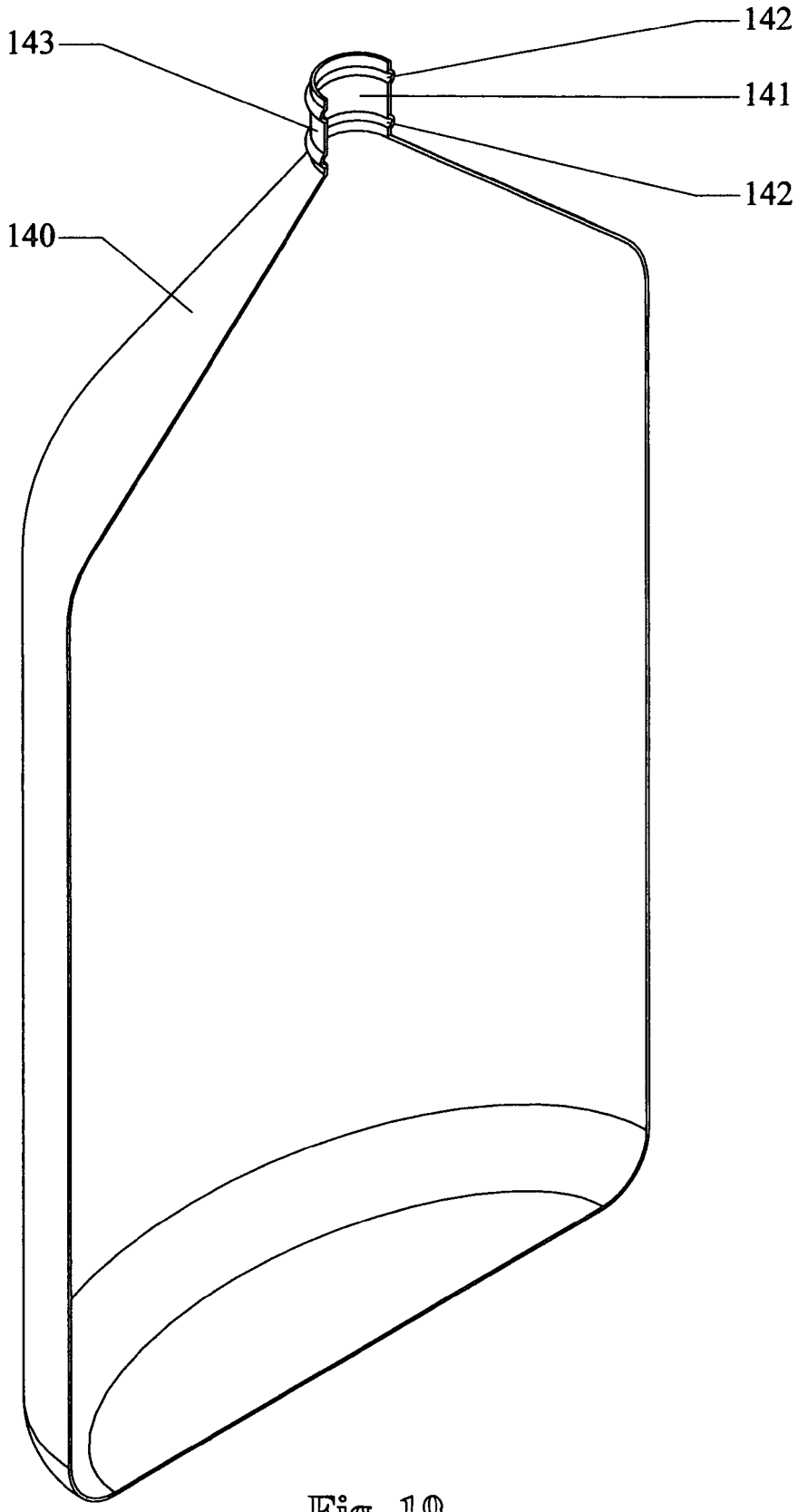
FIG. 19 is an isometric section A-A front view of the flexible bladder 140 seen in the direction of arrows A-A.

Still referring to FIG. 5. Now, with the variable pumping force 163 acting throughout the limit of the downward stroke the air being compressed in the bellows annulus 165 forces the discharge valve 70 to open. The compressed air in the bellows annulus 165 follows arrow A. The air being compressed in the interior space 166 passes through the interior of the open discharge valve 70, as shown by arrow B. Both air streams, A & B, pass through the pump discharge hole 52 in the pump bottom 50 (FIG. 8), through the bottle cap 80 (FIGS. 3, 13, & 15) and, into the annulus 161 (FIG. 3) between the container bottle 130 (FIG. 16) and the flexible bladder 140 (FIG. 19).

Still referring to FIG. 5. When the air pump 162 reaches the limit or bottom of its downward stroke (not shown) the compressed air, from air streams A & B, ceases to flow. The air stream A ceases to flow around the discharge valve 70 and it closes against its sealing surface 55 (FIG. 8). Also, at this instant, the suction valve 110 remains closed against its sealing surface 56 of the pump bottom 50 (FIG. 8) as it has during the downward pumping stroke. The suction valve 110 has been held closed by the air pressure generated in the bellows annulus 165. No compressed air is flowing at the instant of the end of the pumping stroke as both the suction valve 110 and the discharge valve 70 are closed.

Referring now to FIG. 6. FIG. 6 shows the position of the air pump 162 just after the instant of the beginning its upward "suction stroke". The suction valve 110 opens, as shown, due to the negative pressure generated in the bellows annulus 165 as the air pump 162 moves upward. The discharge valve 70 is held closed by the internal air pressure in the interior space 166 that was generated by the first, and subsequent, downward "pumping strokes". Also at this instant, and throughout, the upward "suction stroke" the bottom 13 of the top cap 10 (FIG. 9) must be held against the top 23 of the pump top 20 (FIG. 7), which seals off the air bleed holes 11 (FIG. 9), to maintain any previously generated air pressure in the interior space 166 of the air pump 162. When another downward "pumping stroke" is started the air pump 162 instantly reverts back to the beginning of the downward "pumping stroke as shown and describe in FIG. 5.

Still referring to FIG. 6. By continuing "pumping strokes" (FIG. 5) and "suction strokes" (FIG. 6) of the air pump 162 the total amount of viscous liquid may be expelled from the container bottle 130 at one time, or at several intermediate times.

Referring to FIGS. 1, 2, 3, 4, 5, and 6. It should be noted that for any given size of a container bottle 130, for any given size of a flexible bladder 140, and a any given viscosity of the viscous liquids 160, at a given ambient temperature and atmospheric pressure, the required volume of air, and the pressure of the air, in the annulus 160, necessary to collapse the flexible bladder 140, will be dependent on the diameters and height of the interior and exterior bellows, 40 and 30 respectively.

Referring now to FIG. 7. FIG. 7 shows the pump top 20, the top of the pump top 23, the outside ring 22, the interior surface 24, and the bottom of the pump top 21.

Referring now to FIG. 8 shows the inside ring 54, the outside surface of the inner ring 58, the air suction holes 51, the annulus discharge holes 60, the inner surface 57, the sealing surface 55 of the discharge valve 70 (not shown), the outside ring 53, the sealing surface 56 of the suction valve 110 (not shown), the inside surface 62, and the discharge hole 52 of the pump bottom 50.

Referring now to FIG. 9. FIG. 9 shows the air bleed holes 11, the guide fingers 12, the outside surface 16, the inner ring 15, and the bottom 13 of the top cap 10.

Figure 10:
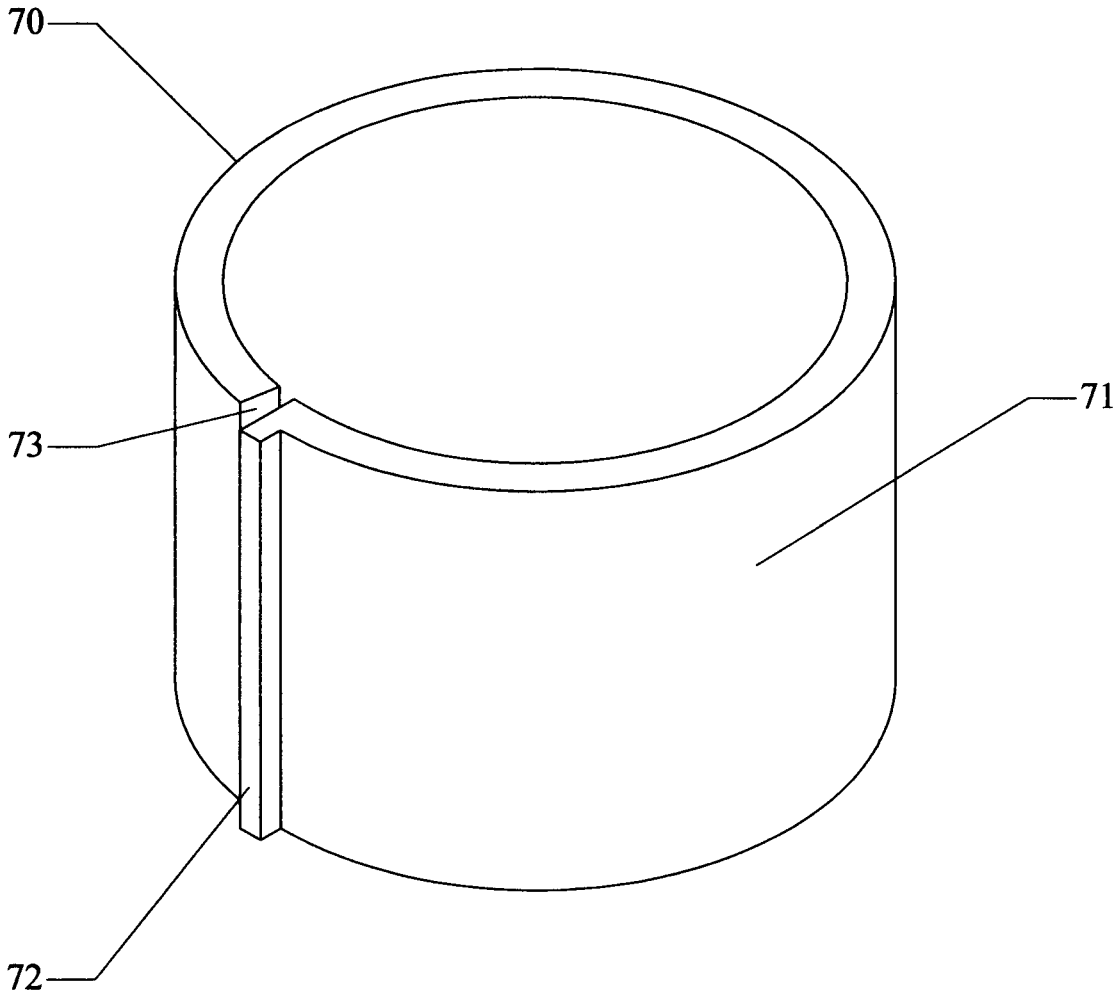
FIG. 10 is an isometric front view of the discharge valve 70 seen in the direction of arrows A-A.

Referring now to FIG. 10. FIG. 10 shows the compression slot 73, the locating dog 72, and the sealing surface 71 of the discharge valve 70.

Figure 11:
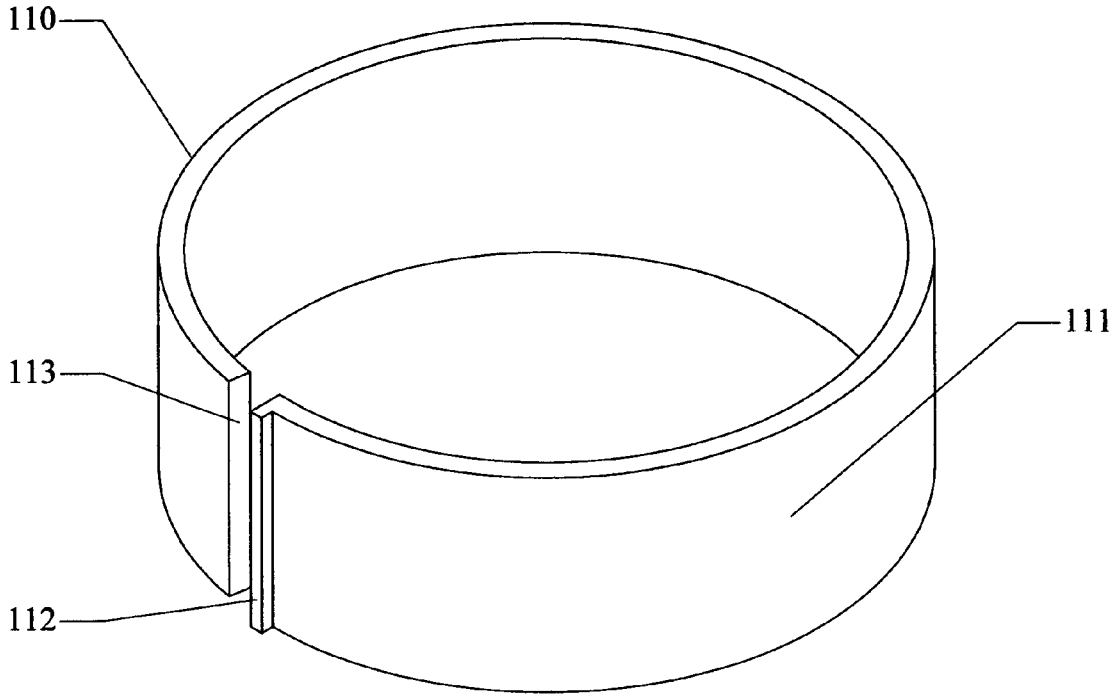
FIG. 11 is an isometric front view of the suction valve 110 seen in the direction of arrows A-A.

Referring now to FIG. 11. The suction valve 110 has a compression slot 113, and a locating dog 112, similar to the discharge valve 70, and is prevented from rotation in the same manner as the discharge valve 70 discussed above in FIG. 12 but not shown here.

Figure 12:
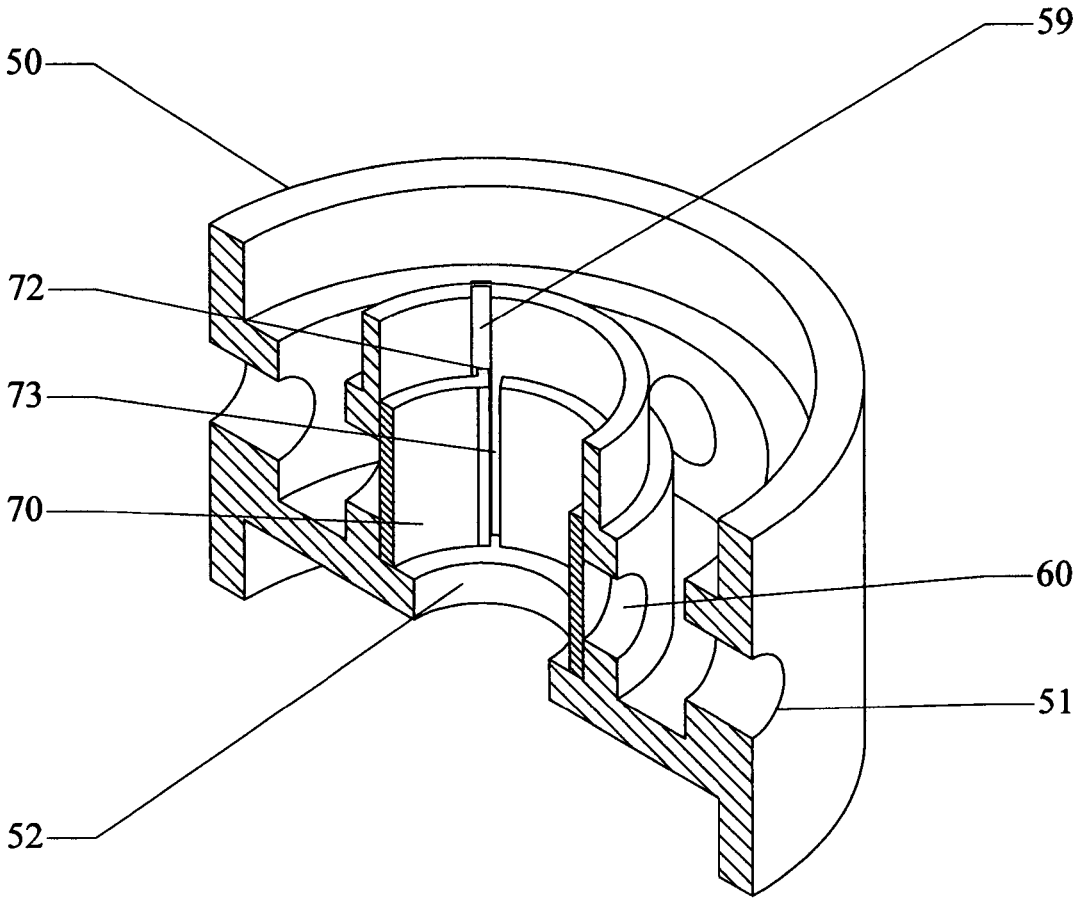
FIG. 12 is an isometric section B-B front view of the pump bottom 50 and discharge valve 70 seen in the direction of arrows B-B.

Referring now to FIG. 12. FIG. 12 shows the pump bottom 50 in an isometric section along section line B-B as shown in FIG. 2. This view is of the pump bottom 50 (FIG. 8) and the discharge valve 70 (FIG. 10) only. The suction valve 110 (FIG. 11) is not shown. The discharge valve 70 is shown "at rest" or closed.

Still referring to FIG. 12. The locating dog 72 of the discharge valve 70 (FIG. 10) fits into the locating slot 59 of the pump bottom 50. The locating dog 72 prevents the compression slot 73 (FIG. 10) from rotation with use and lining up with the annulus discharge hole 60 which would cause the air pump 162 to leak and the air pump 162 would not function as designed.

Still referring to FIG. 12. The suction valve 110 (not shown) has a locating dog 112 (not shown) that fits interior to and adjacent to the air suction holes 51 that has a locating dog 112 (not shown) that operates as does the discharge valve 70 described in the above paragraph.

Figure 13:
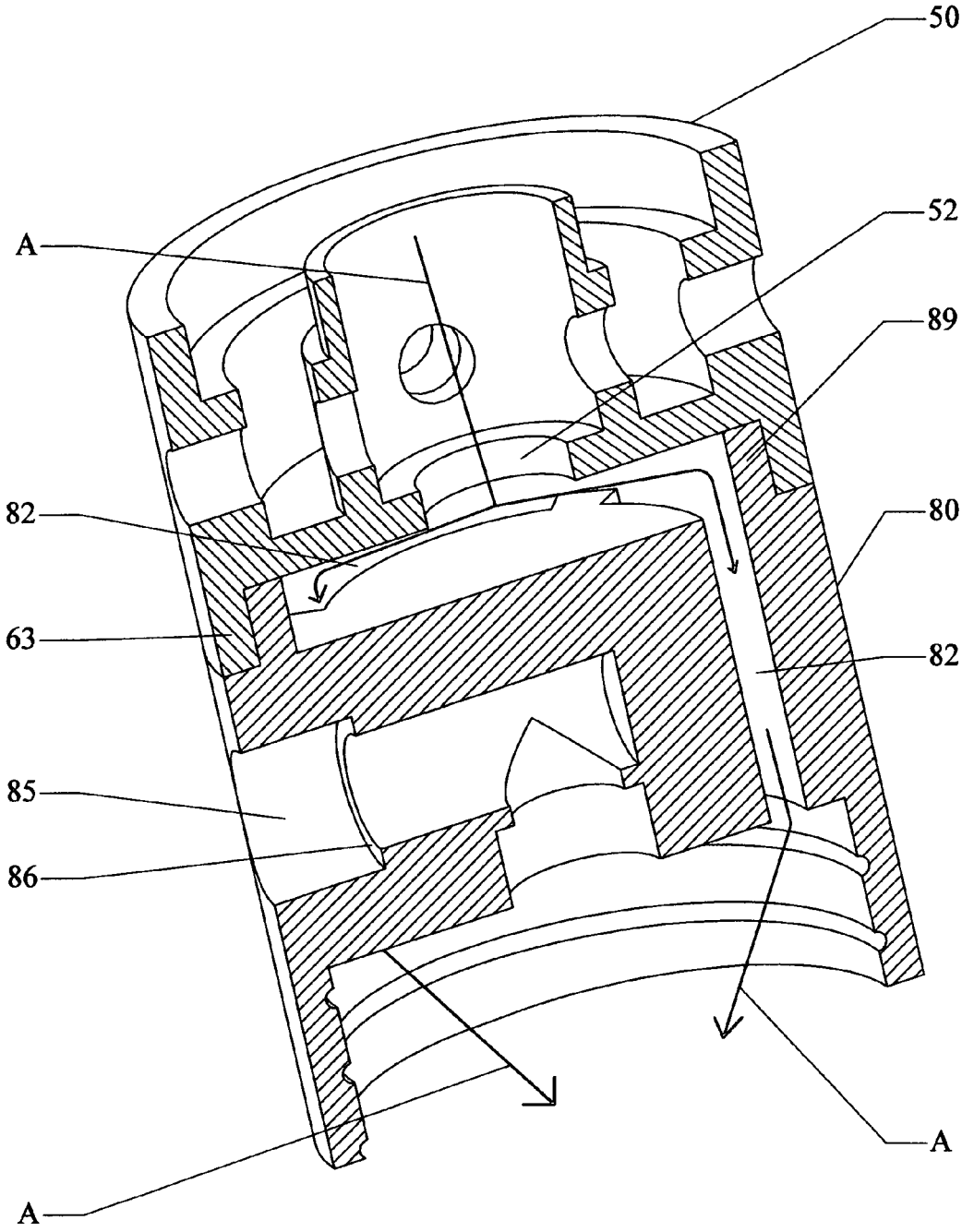
FIG. 13 is a rotated isometric section A-A front view of the pump bottom 50 and bottle cap 80 seen in the direction of arrows A-A.
Figure 15:
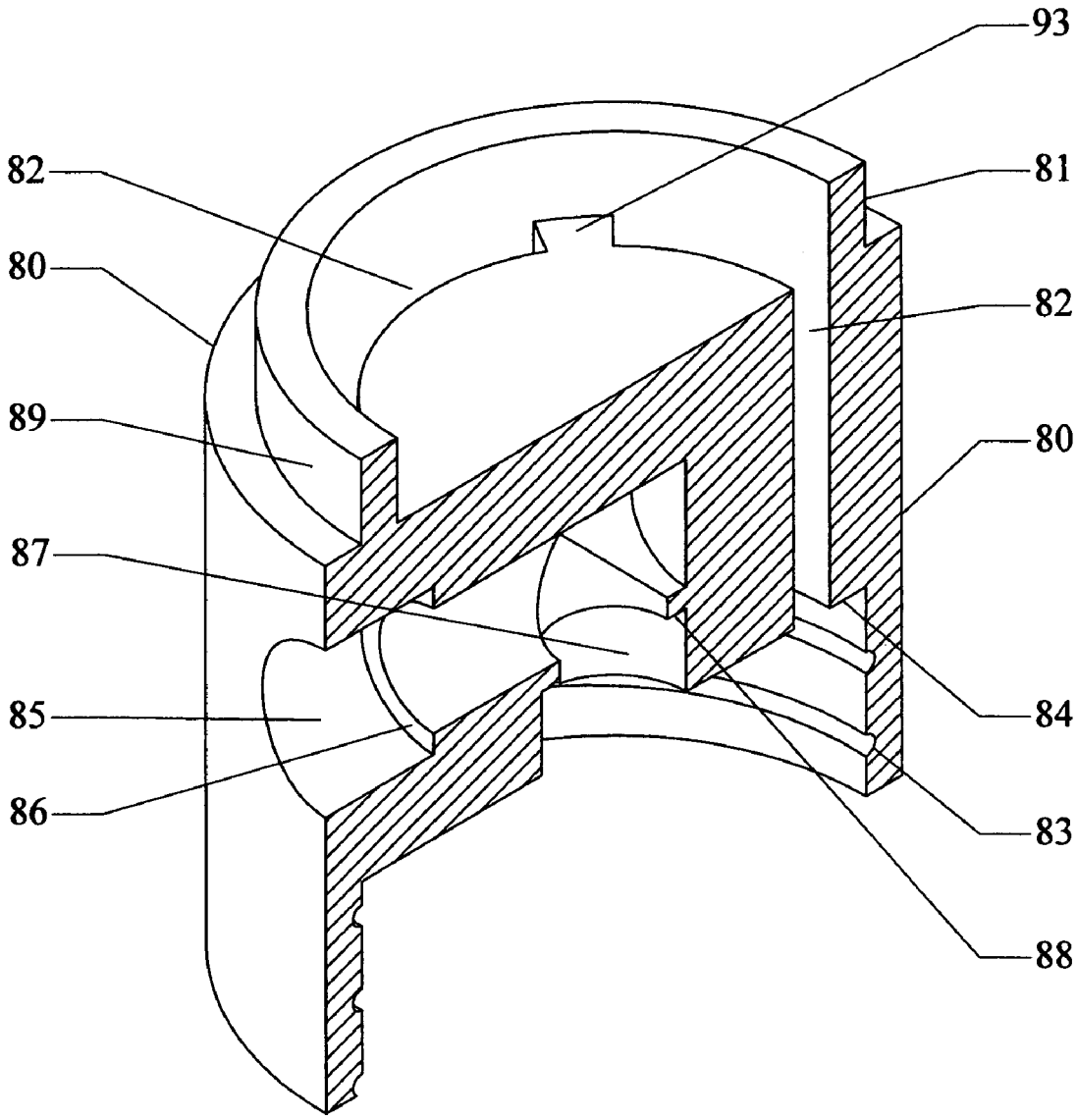
FIG. 15 is an isometric section A-A front view of the bottle cap 80 seen in the direction of arrows A-A.

Referring now to FIG. 13. FIG. 13 is composed of two parts, the pump bottom 50 (FIG. 8) and the bottle cap 80 (FIG. 15) that have been joined by glue or welding of the inside surface 62 (not shown) of the lower ring 63 (not shown) of the pump bottom 50 (FIG. 8) and the outer surface 89 (not shown) of the upper ring 81 (not shown) of the bottle cap 80 (FIG. 15). This air tight connection connects the air pump 162 (not shown), which fits above the pump bottom 50 and the container bottle 130 (not shown) which fits below the bottle cap 80.

Still referring to FIG. 13. Arrows A shows the path of the compressed air, from the air pump 162, (FIGS. 4, 5, & 6) passing through the pump discharge hole 52 of the pump bottom 50 (FIG. 8) and into the air passage slots 82 (FIG. 15) and into the annulus 161 as shown in FIG. 3.

Figure 14:
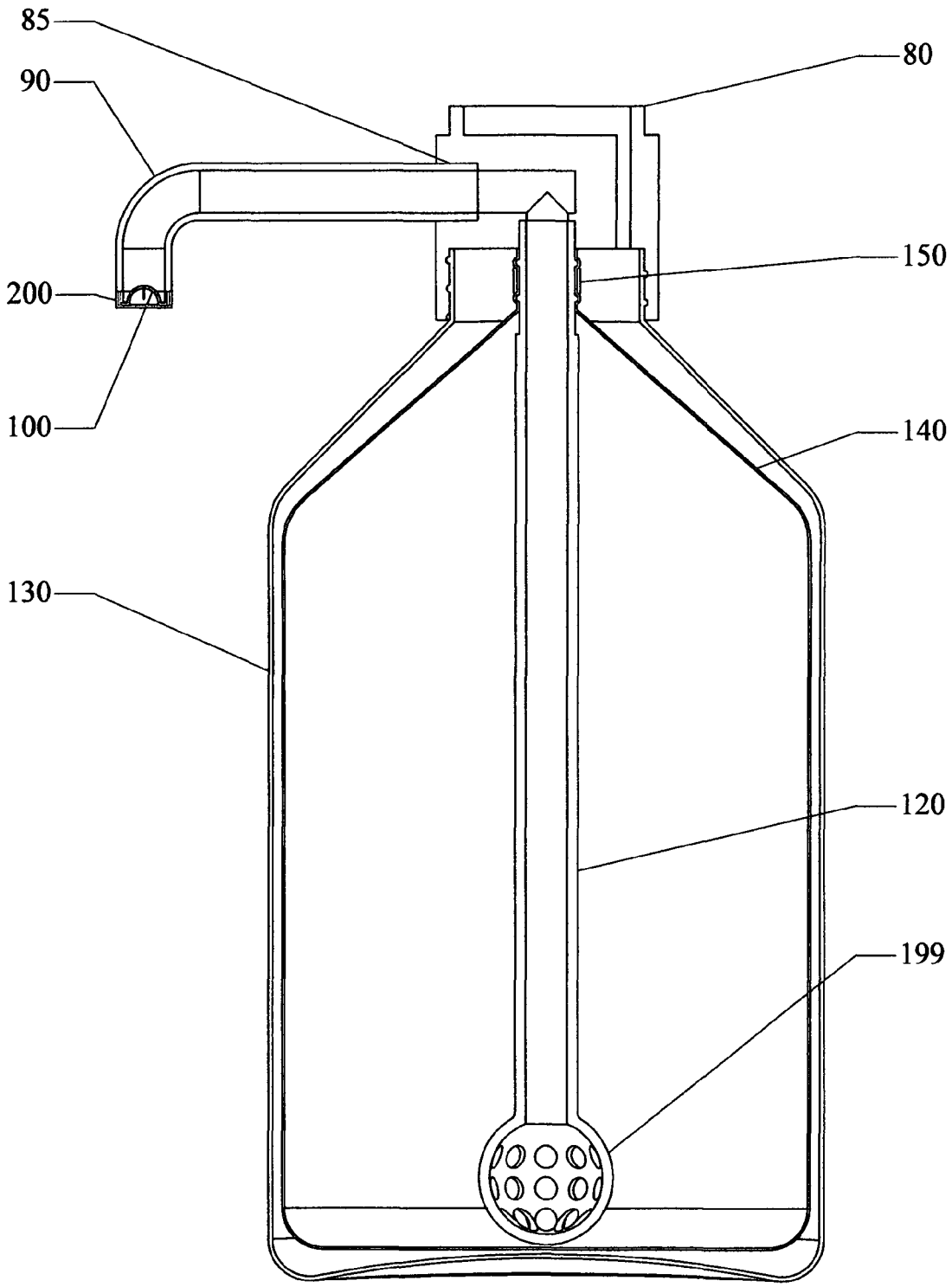
FIG. 14 is a front view along section A-A of the container bottle 130 seen in the direction of arrows A-A.

Referring now to FIG. 14. FIG. 14 shows the container bottle 130 assembly as defined in FIG. 1. The container bottle 130 is constructed from the following parts: the bottle cap 80 (FIG. 15), the container bottle 130 (FIG. 16), the flexible bladder 140 (FIG. 19), the tube 120 (FIGS. 18 & 24), the clip 150 (FIG. 20), the discharge spout 90 (FIG. 17), the flex disk 100 (FIG. 21), and the keep 200 (FIG. 22).

Still referring to FIG. 14. The bottle cap 80 is screwably attached to the container bottle 130 by the male threads 171 (FIG. 16) of the container bottle 130 (FIG. 16) screwed into the female threads 83 (FIG. 15) of the bottle cap 80 (FIG. 15) engaging the surface 84 of the bottle cap 80 (FIG. 15) with the bottle top 172 of the container bottle 130 (FIG. 16) which forms an air tight seal.

Still referring to FIG. 14. The discharge spouts 90 outer surface 91 (FIG. 17) is slideably engaged with the hole 85 of the bottle cap 80 to the stop 86 (FIG. 15) and the outer surface 91 (FIG. 17) is glued or welded into the hole 85 (FIG. 15) of the bottle cap 80 in an air tight connection.

Still referring to FIG. 14. The tubes 120 outer surface 121 (more clearly shown in FIG. 18) is slideably engaged with the hole 87 (FIG. 15) of the bottle cap 80 to the stop 88 (FIG. 15) and the outer surface 121 (FIG. 18) is glued or welded to the hole 87 (FIG. 15) of the bottle cap 80 in an air tight connection.

Figure 18:
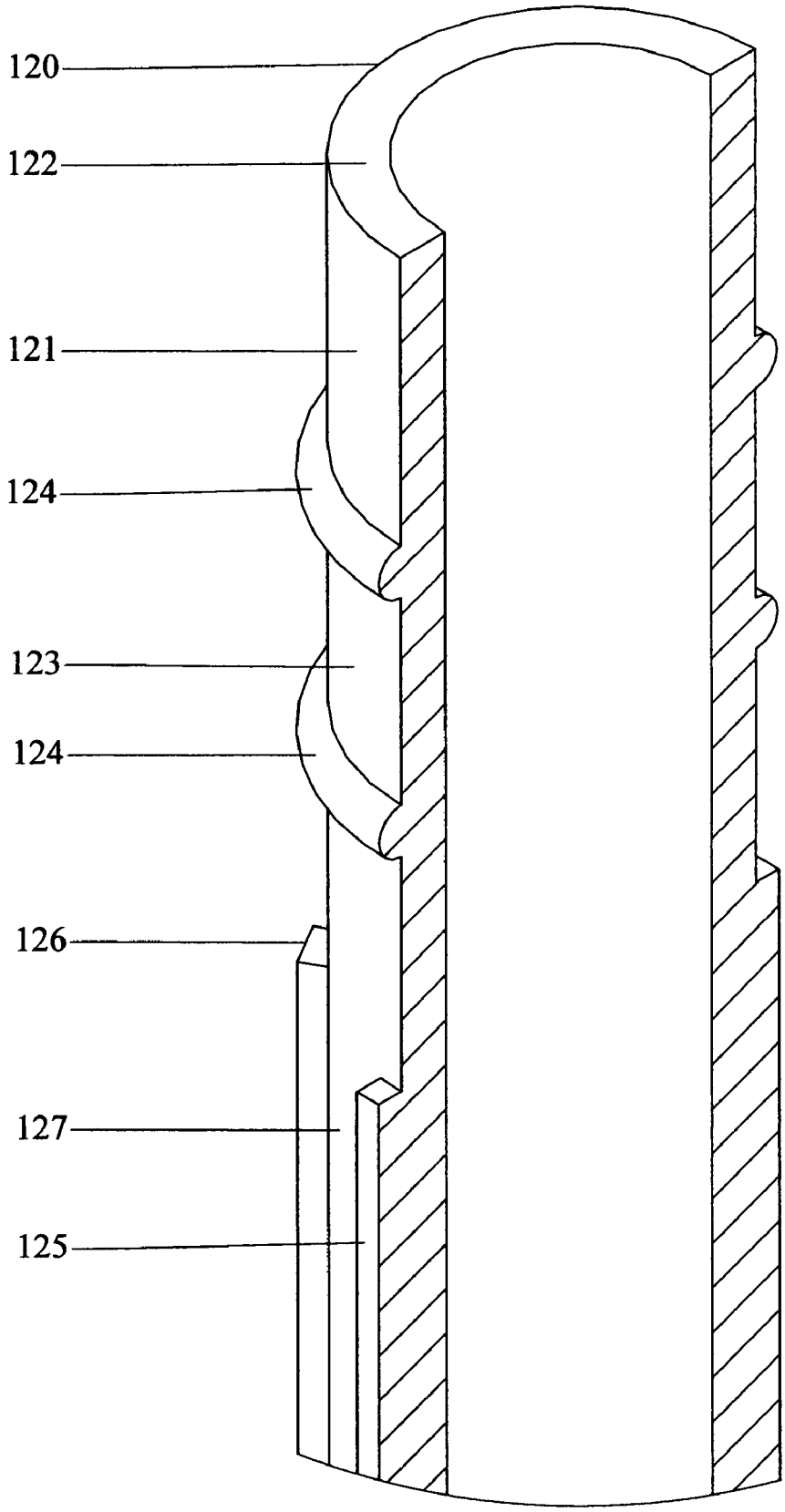
FIG. 18 is an isometric section A-A front view of the tube 120 seen in the direction of arrows A-A of the top portion of the tube 120.

Still referring to FIG. 14. The flexible bladder 140 is expanded and slid over the tube 120 until its inner sealing surface 141 (FIG. 19) is opposite the sealing surface 123 (FIG. 18) of the tube 120 and the two female recesses 142 of the flexible bladder 140 (FIG. 19) are positioned over the two male seal ring 124 of the tube 120 (FIG. 18). The inner surface 151 of the clip 150 (FIG. 20) is positioned over the outer surface 143 of the flexible bladder 140 (FIG. 19) between the two female recesses 142 of the flexible bladder 140 (FIG. 19) and crimped in place with a crimping device, somewhat like a pair of pliers, (not shown) squeezing the clip 150 over the flexible bladder 140 (FIG. 19) and sealing it to the tube 120 in an air tight manner. The gap 152 of the clip 150 (FIG. 20) is reduced by this squeezing sealing compression action.

Referring now to FIG. 15. FIG. 15 shows the outer surface of the upper ring 89, the hole 87, the hole 85, the stop 86, the upper ring 81, the air passage slots 82, the surface 84, the female threads 83, the web 93, and the stop 88 of the bottle cap 80.

Figure 16:
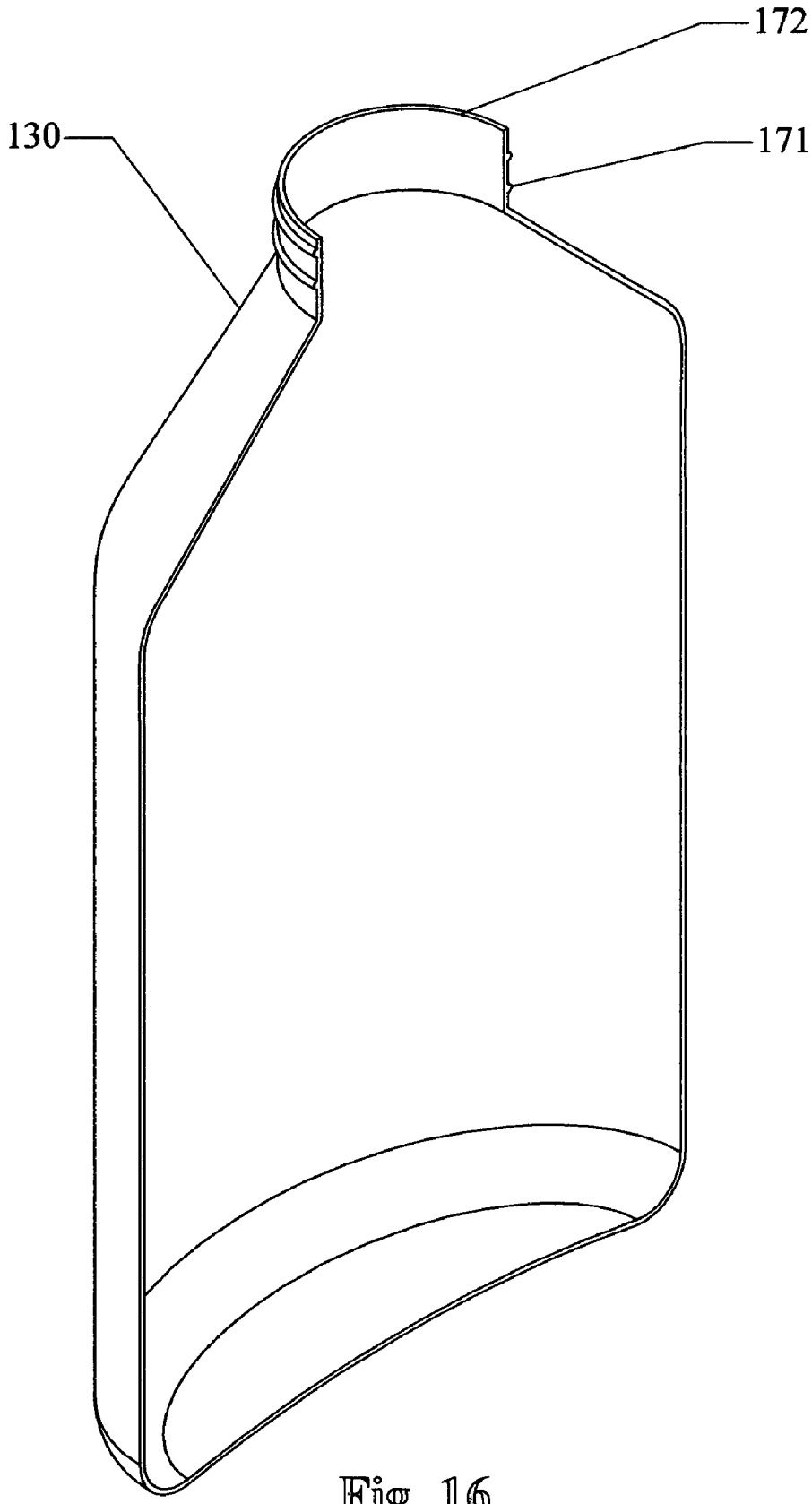
FIG. 16 is an isometric section A-A front view of the container bottle 130 seen in the direction of arrows A-A.

Referring mow to FIG. 16. FIG. 16 shows the bottle top 172, and the male threads 171 of the container bottle 130.

Figure 17:
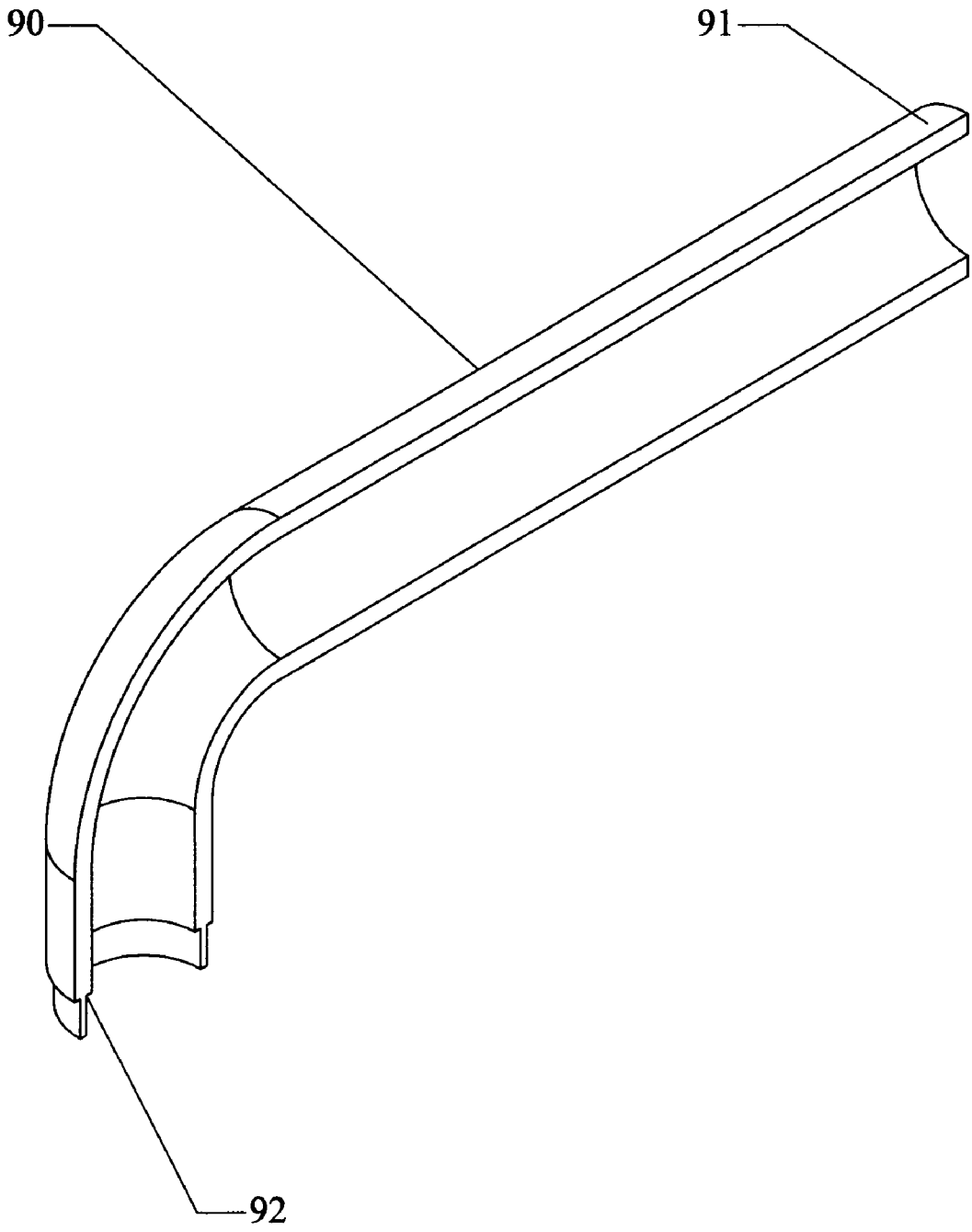
FIG. 17 is an isometric section A-A front view of the discharge spout 90 seen in the direction of arrows A-A.

Referring now to FIG. 17. FIG. 17 shows the outer surface 91, and the inner ledge 92 of the discharge spout 90.

Referring now to FIG. 18. FIG. 18 is an expanded view of the top portion of the tube 120. The viscous liquid 160 (FIG. 3) that flows up and out of the container bottle 130 (FIG. 3) is propelled through the tube 120 by the air pressure generated by the air pump 162 (see FIGS. 3, 4, 5, & 6) squeezing the flexible bladder 140 (FIGS. 3 & 19) against the viscous liquid 160 (FIG. 3). When almost all of the viscous liquid 160 (FIG. 3) has been displaced by the flexible bladder 140 (FIGS. 3 & 19) the flexible bladder 140 (FIGS. 3 & 19) will eventually come to rest on the outer surface 125 of the ribs 126. Some viscous liquid 160 (FIG. 3) will be trapped in the annulus 127 between the ribs 126 and the outer surface 125 of the ribs 126 which is the flow path (not shown) of the very last part of the viscous liquid 160 (not shown see FIG. 3) that came in the container bottle 130 (FIG. 3).

Referring mow to FIG. 19. FIG. 19 shows inner sealing surface 141, the female recess 142, the outer surface 143, of the flexible bladder 140.

Figure 20:
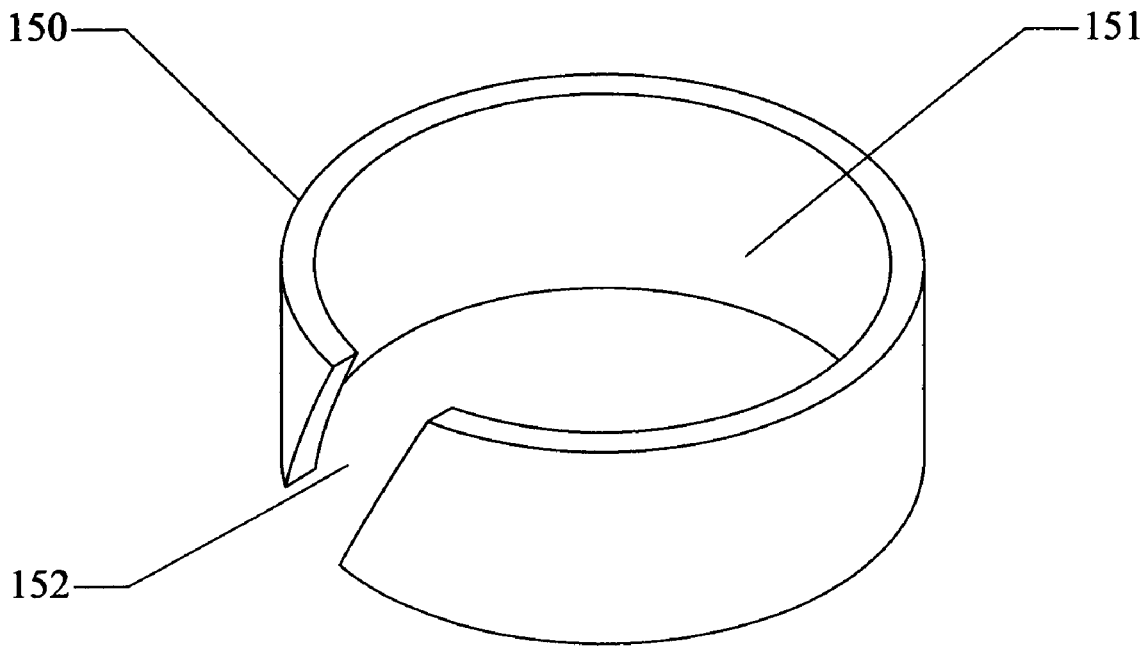
FIG. 20 is an isometric front view of the clip 150 seen in the direction of arrows A-A.

Referring now to FIG. 20. FIG. 20 shows the inner surface 151, ant the gap 152 of the clip 150.

Figure 21:
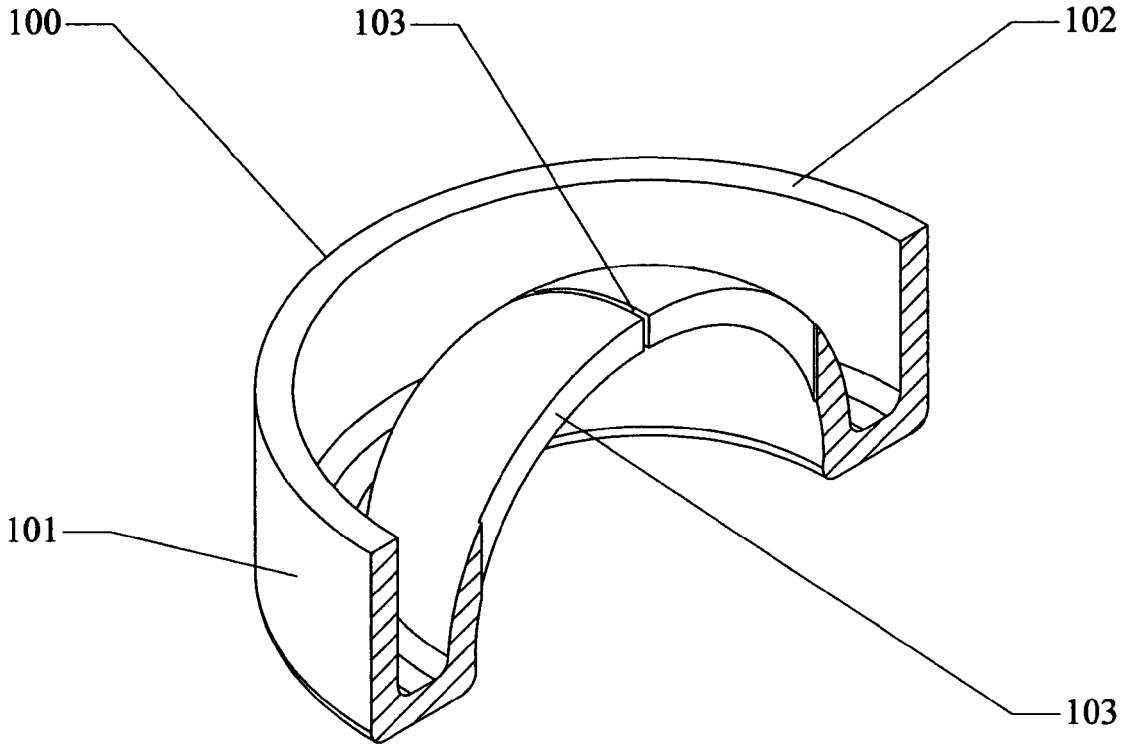
FIG. 21 is an isometric section A-A front view of the flex disk 100, in its up position, seen in the direction of arrows A-A.
Figure 22:
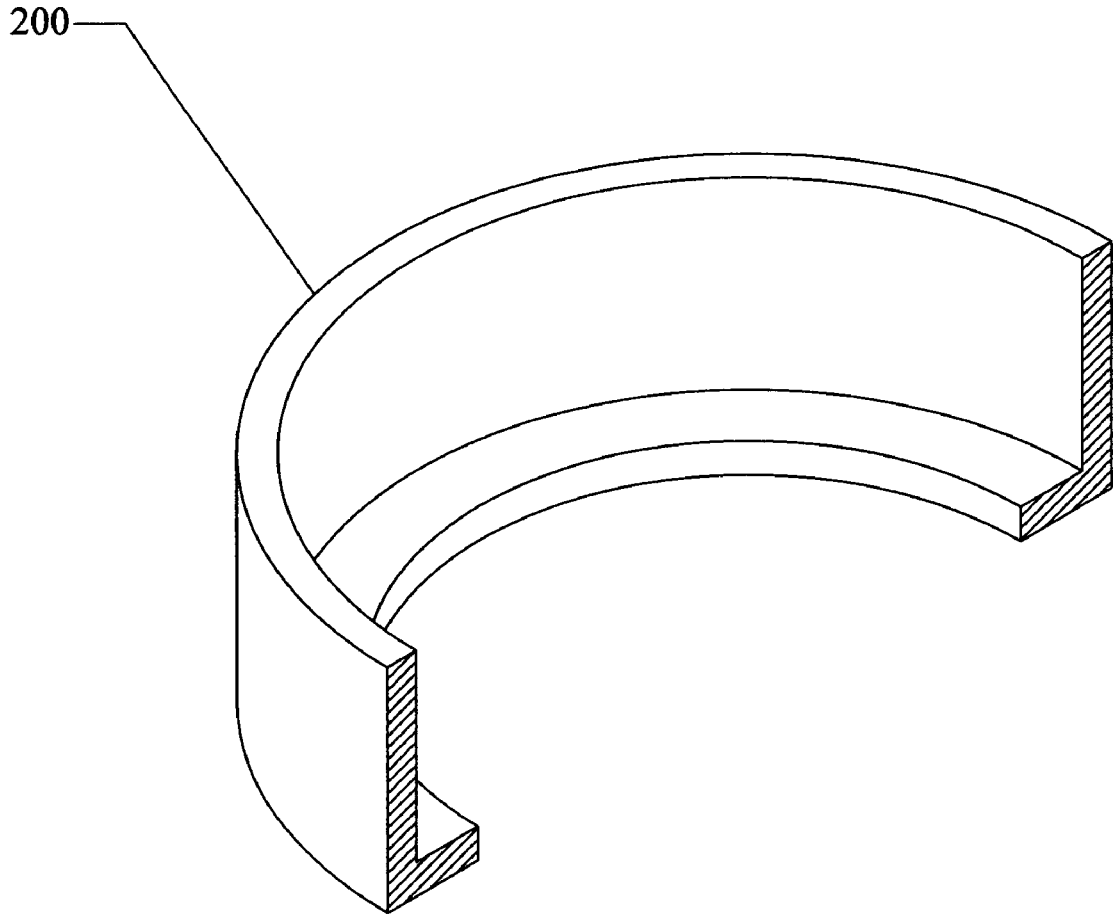
FIG. 22 is an isometric section A-A front view of the retainer 200 seen in the direction of arrows A-A.

Referring now to FIG. 21. FIG. 21 shows the flex disk 100 in its up and "closed" position. The slots 103 that are arranged here in a "star" pattern are closed and liquid tight. The outer surface 101 of the flex disk 100 is slid up inside the discharge spout 90 (FIG. 17) until its top ledge 102 comes in contact with the inner ledge 92 of the discharge spout 90 (not shown, see FIG. 17). The retainer 200 (FIG. 22) holds the flex disk 100 in place.

Still referring to FIG. 21. The flex disk 100, known in the art, in its present configuration, prevents viscous liquids 160 (FIG. 3) from "drooling" out the discharge spout 90 (FIG. 17).

Referring now to FIG. 22. FIG. 22 shows the retainer 200 that holds the flex disk 100 (not shown) to the discharge spout 90 (not shown).

Figure 23:
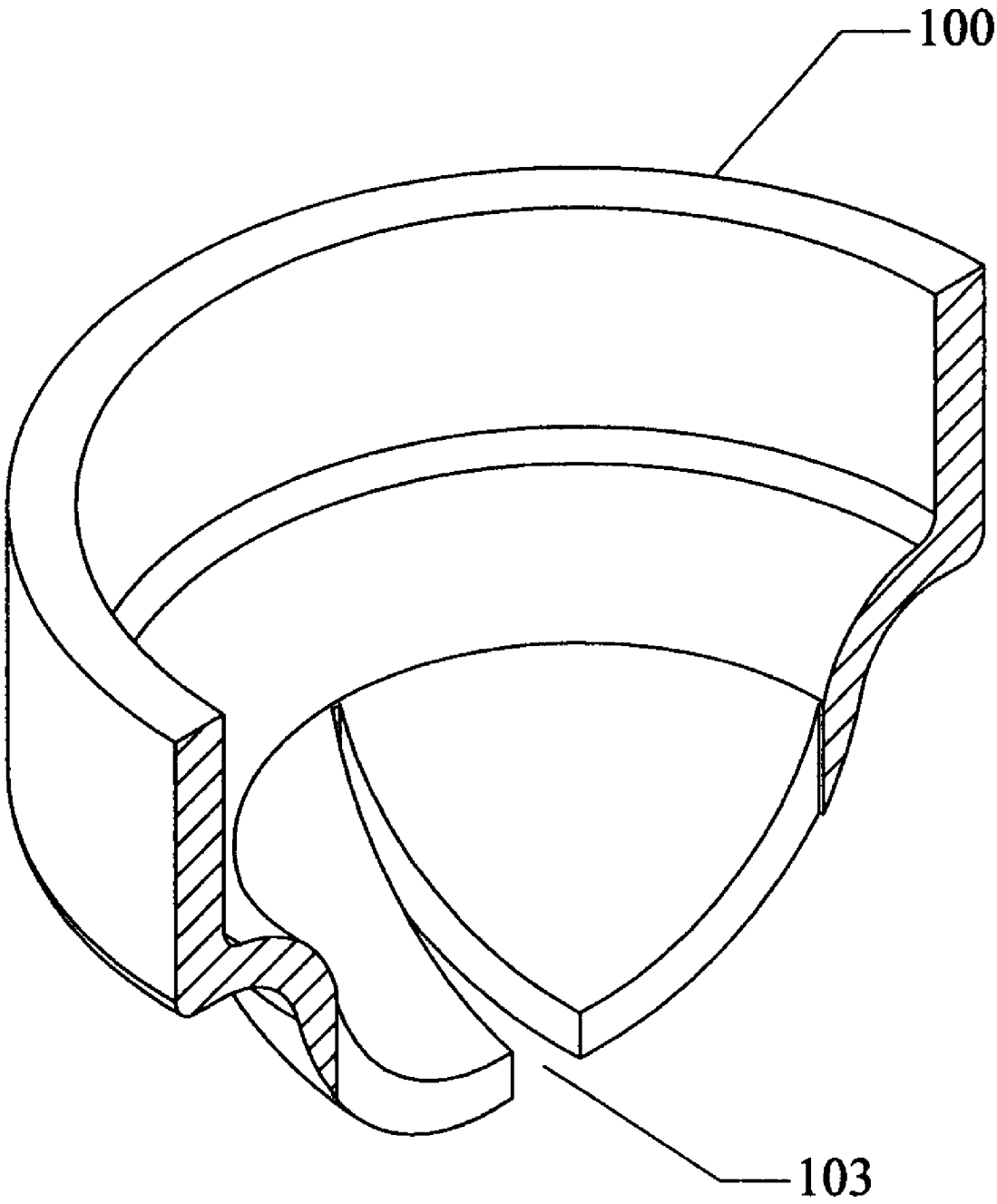
FIG. 23 is an isometric section A-A front view of the flex disk 100, in its down position, seen in the direction of arrows A-A.

Referring now to FIG. 23. When the viscous liquid 160 (FIG. 3) is being pumped from the container bottle 130 (FIG. 3) the flex disk 100 is flexing downward and the slots 103 are spread open (FIGS. 3 & 23) allowing the viscous liquid 160 (FIG. 3) to pass through the flex disk 100 and exit the container bottle 130 (FIG. 3).

Figure 24:
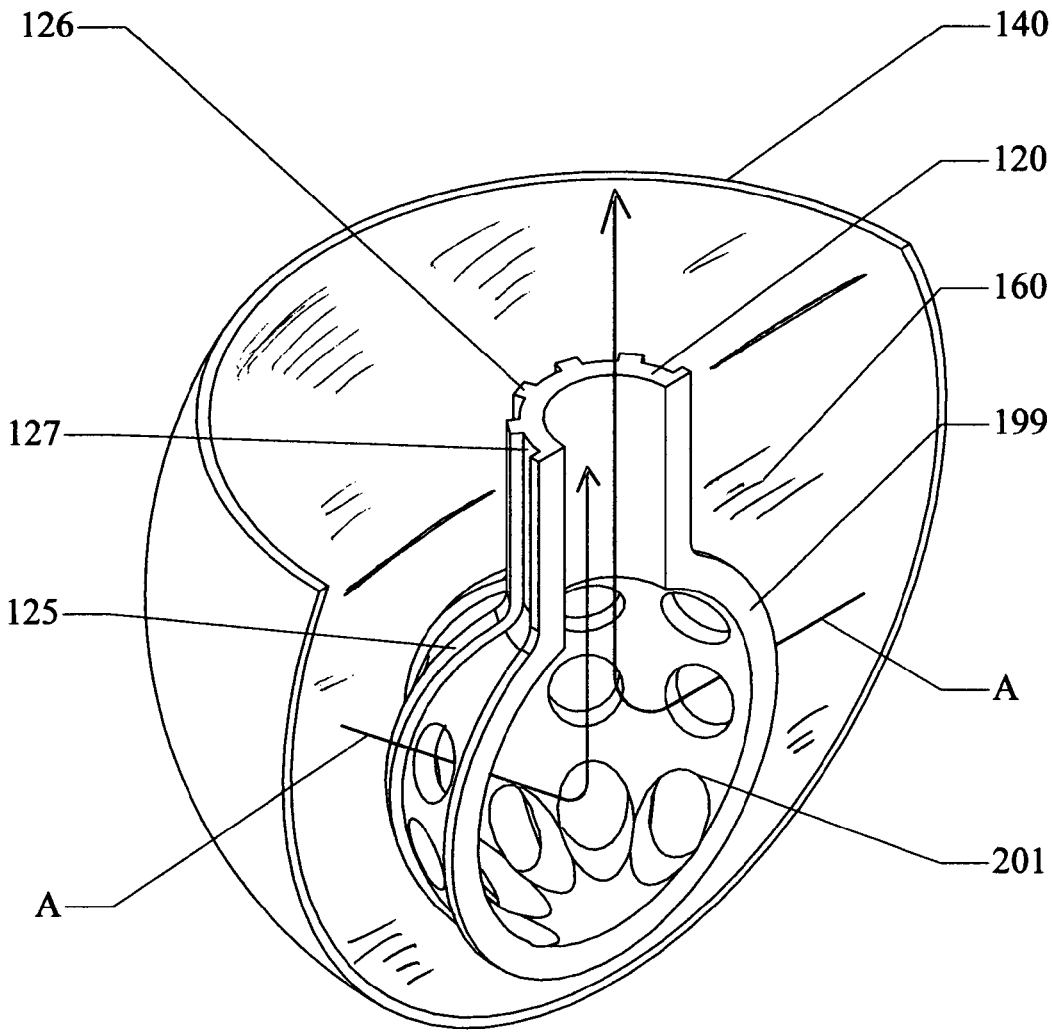
FIG. 24 is an isometric section A-A front view of the tube 120 and flexible bladder 140, and ball 199, seen in the direction of arrows A-A.

Referring now to FIG. 24. This is an view of the lower portion of the tube 120 and flexible bladder 140 as the flexible bladder 140 has partially and almost completely collapsed around the tube 120 due to the air pressure generated by the air pump 162 (not shown) on the outside of the flexible bladder 140 forcing the viscous liquids 160 through the annulus of the ribs 127 (FIG. 18) as the flexible bladder 140 comes to rest on the top of the ribs 125 (FIG. 18) driving the viscous liquids 160 through a plurality of holes 201 and up the tube 120 as shown by arrows A.

Referring now to figures of this invention. All parts of this invention may be made from a material known in the art as "plastic" whether it be a PE, PP, HDPE, LDPE, PET, or other polyolefin's, and or PVC, PS, ABS, with the exception of the clip 120 and retainer 200 which may be made from a metallic material as known in the art as aluminum or stainless steel.

Wherein the present invention has been described in particular relation to the drawings attached hereto, it should be understood that other and further modifications apart from those shown or suggested herein may be made within the scope of the invention. Reference herein to details of the illustrated embodiments is not intended to limit the scope of the invention, which are recited and those features regarded as essential to the invention within the claims.

What is claimed is:

1. Apparatus for dispensing liquid comprising a dispenser bottle having a dispensing opening therein;

a flexible bladder mounted in the dispenser bottle and forming an annular space therewith, the bladder having a bladder opening therein and being connected to dispenser bottle by connecting the two openings together, the bladder being fillable with a liquid to be dispensed, a discharge tube having an inlet end and an outlet end, the discharge tube having an inlet opening at the inlet end thereof and positioned within the bladder in spaced relation with the bladder opening, the discharge tube being connected at its outlet end to the bladder and the dispenser bottle at their openings, the discharge tube having a discharge opening at its outlet end in communication with the openings in the bottle and bladder;

and means for exerting a fluid pressure in the annular space to force the bladder to collapse and thereby force liquid within the bladder into the inlet opening of the discharge tube and thence out of the discharge opening of the discharge tube and the opening in the bottle; and said means for exerting a fluid pressure in the annular space provided with means for automatically equalizing pressure between outside atmosphere and said annular space without allowing air to enter into the bladder thereby preventing accidental discharge of liquid from the discharge tube due to changes in temperature or atmospheric pressure and preventing contamination of the fluid located within the bladder.

2. Apparatus for dispensing liquid as set forth in claim 1 wherein the discharge tube is provided with a perforated ball mounted at the inlet end of the discharge tube.

3. Apparatus for dispensing liquid as set forth in claim 1 wherein the discharge tube is provided with longitudinal ribs on the outer periphery of the discharge tube extending from the inlet end of the discharge tube to the outlet end thereof and having longitudinal grooves there between to provide passageways for the flow of liquid from the interior of the bladder to the inlet end of the discharge tube when the bladder collapses over the discharge tube.

4. Apparatus for dispensing liquid as set forth in claim 1 wherein the means for exerting fluid pressure in the annular space is a pumping device.

5. Apparatus for dispensing liquid comprising:

a dispenser bottle having a dispensing opening therein;

a flexible bladder mounted in the dispenser bottle and forming an annular space therewith, the bladder having a bladder opening therein and being connected to dispenser bottle by connecting the two openings together, the bladder being fillable with a liquid to be dispensed, a discharge tube having an inlet end and an outlet end, the discharge tube having an inlet opening at the inlet end thereof and positioned within the bladder in spaced relation with the bladder opening, the discharge tube being connected at its outlet end to the bladder and the dispenser bottle at their openings, the discharge tube having a discharge opening at its outlet end in communication with the openings in the bottle and bladder;

means for exerting a fluid pressure in the annular space to force the bladder to collapse and thereby force liquid within the bladder into the inlet opening of the discharge tube and thence out of the discharge opening of the discharge tube and the opening in the bottle:

said means for exerting fluid pressure in the annular space is a pumping device:

a pump bottom having an inner circumferential ring and an outer circumferential ring concentric with the inner ring;

the inner ring having an inner circumferential surface with at least one opening therethrough;

a first circumferential sealing member bearing against the inner circumferential surface of the inner ring to close off the openings in the inner ring and constituting a discharge valve;

the outer ring having an inner circumferential surface with at least one opening therethrough;

a second circumferential sealing member bearing against the inner circumferential surface of the outer ring to close off the openings in the outer ring and constituting an inlet valve;

a generally circular pump top mounted in spaced parallel relation with respect to pump bottom and having an inner circumferential ring and an outer circumferential ring concentric with the inner ring;

the outer ring of the pump top having an inner circumferential surface;

the inner ring of the pump top having an inner surface defining an opening for receiving a longitudinally reciprocal top cap;

a top cap having a cylindrical body and a flat top thereon, the cylindrical body of the top cap having an outer surface whose diameter is equal to the diameter of the opening in the pump top whereby the top cap is longitudinally reciprocal in the opening in the pump top from a first position of repose above the pump top to a second position representing a downward movement of the top cap as a result of application of downward pressure thereon;

the cylindrical body of the top cap having a radial opening therethrough just below the flat top thereof for communicating with the atmosphere when the top cap is in its first position;

the top cap having fingers on its cylindrical body engageable with the inner ring of the pump top to prevent upward movement of the top cap beyond the first position thereof;

an inner cylindrical bellows member having an upper end and a lower end, the upper end of the inner bellows member being attached to the cylindrical body of the top cap and the lower end of the inner bellows member being attached to the inner ring of the pump bottom in air tight relation;

an outer cylindrical bellows member having an upper end and a lower end, the upper end of the outer bellows member being attached to the outer ring of the pump top and the lower end of the outer bellows member being attached to the outer of the pump bottom in air tight relation;

the inner and outer bellows members forming an annular space therebetween, the bellows members being compressible but having resilient spring-like characteristics causing then to return to their original positions after pumping pressure has been released from the top cap;

whereby, when pressure is applied in a downstroke against the top cap, the fluid trapped in the annular space will force open the discharge valve and force fluid out of the discharge opening of the pump bottom; and whereby, when pressure is released from the top cap, the bellows will return to their original position, creating a low pressure in the annular space so as to open the inlet valve and allow atmospheric air into the annular space.

* * * * *